US010735861B2

(12) United States Patent
Butten et al.

(10) Patent No.: US 10,735,861 B2
(45) **Date of Patent: *Aug. 4, 2020**

(54) SPATIAL LOW-CROSSTALK HEADSET

(71) Applicant: HM Electronics, Inc., Carlsbad, CA (US)

(72) Inventors: Charles Butten, Richmond, CA (US); Karl Knoblock, Encinitas, CA (US); Robert Snyder, Spring Valley, CA (US)

(73) Assignee: HM Electronics, Inc., Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/268,741

(22) Filed: Feb. 6, 2019

(65) Prior Publication Data

US 2019/0174231 A1 Jun. 6, 2019

Related U.S. Application Data

(63) Continuation of application No. 15/884,704, filed on Jan. 31, 2018, now Pat. No. 10,237,654.

(Continued)

(51) Int. Cl.

*H04R 3/14* (2006.01)
*H04R 1/40* (2006.01)

(Continued)

(52) U.S. Cl.

CPC ..... *H04R 3/14* (2013.01); *H04R 1/105* (2013.01); *H04R 1/406* (2013.01); *H04R 1/083* (2013.01);

(Continued)

(58) Field of Classification Search

None

See application file for complete search history.

(56) References Cited

U.S. PATENT DOCUMENTS 5,291,558 A 3/1994 Ross
6,154,721 A * 11/2000 Sonnic ..... G10L 25/78 704/233

(Continued)

FOREIGN PATENT DOCUMENTS

EP 1189480 3/2002
JP 2005072703 3/2005

OTHER PUBLICATIONS

Harry F. Olson, Gradient Microphones J. Acoustical Society Am. 17, No. 3 (Jan. 1946), 7 pages.

(Continued)

*Primary Examiner* — Qin Zhu
(74) *Attorney, Agent, or Firm* — Esplin & Associates, PC

(57) ABSTRACT

An apparatus for reducing cross-talk between transmitted audio signals and received audio in a headset. The headset includes one or more of a set of earphones, a headset frame, a microphone boom with an array of MEMS microphone configured to isolate the earphone audio from the microphone audio, a VOX circuit, low crosstalk cable(s), and/or other components. Sets of microphones may be enabled and/or disabled to reduce cross-talk between received audio signals and transmitted audio signals. The VOX circuit is configured to reduce cross-talk between received audio signals and transmitted audio signals.

12 Claims, 28 Drawing Sheets

Related U.S. Application Data

(60) Provisional application No. 62/457,090, filed on Feb. 9, 2017.

(51) Int. Cl.

| | |
|---|---|
| ***H04R 1/10*** | (2006.01) |
| ***H04R 3/00*** | (2006.01) |
| ***H04R 19/04*** | (2006.01) |
| ***H04R 3/04*** | (2006.01) |
| ***H04R 1/08*** | (2006.01) |

(52) U.S. Cl.

CPC ..... *H04R 1/1008* (2013.01); *H04R 1/1033* (2013.01); *H04R 3/005* (2013.01); *H04R 3/04* (2013.01); *H04R 19/04* (2013.01); *H04R 2201/003* (2013.01); *H04R 2201/107* (2013.01); *H04R 2201/403* (2013.01); *H04R 2201/405* (2013.01)

(56) References Cited

U.S. PATENT DOCUMENTS

| | | | | |
|---|---|---|---|---|
| 6,295,366 | B1 | 9/2001 | Haller | |
| 6,496,589 | B1 | 12/2002 | Pham | |
| 8,452,023 | B2 * | 5/2013 | Petit | G10L 21/0208 381/71.8 |
| 9,655,399 | B1 | 5/2017 | Supper | |
| 2006/0120537 | A1 * | 6/2006 | Burnett | G10K 11/178 381/71.6 |
| 2006/0133622 | A1 * | 6/2006 | Chen | H04M 1/03 381/92 |
| 2007/0088544 | A1 | 4/2007 | Acero | |
| 2008/0201138 | A1 * | 8/2008 | Visser | G10L 21/0208 704/227 |
| 2009/0290739 | A1 * | 11/2009 | Edwards | H04R 25/305 381/328 |
| 2010/0128887 | A1 | 5/2010 | Lee | |
| 2011/0044460 | A1 | 2/2011 | Rung | |
| 2011/0116750 | A1 | 5/2011 | Terlizzi | |
| 2011/0174515 | A1 | 7/2011 | Siahaan | |
| 2012/0273248 | A1 | 11/2012 | Tamaki | |
| 2014/0161296 | A1 * | 6/2014 | Andersen | H04R 1/083 381/361 |
| 2014/0172421 | A1 * | 6/2014 | Liu | H04R 1/1083 704/227 |
| 2014/0251651 | A1 | 9/2014 | Huang | |
| 2015/0172807 | A1 | 6/2015 | Olsson | |
| 2016/0112817 | A1 * | 4/2016 | Fan | H04R 29/004 381/94.7 |
| 2017/0040087 | A1 | 2/2017 | Armbrecht | |
| 2017/0078488 | A1 * | 3/2017 | Cartwright | H04M 3/568 |
| 2017/0110142 | A1 | 4/2017 | Fan | |
| 2017/0263267 | A1 * | 9/2017 | Dusan | G10L 25/78 |
| 2018/0091882 | A1 | 3/2018 | Christiansen | |
| 2018/0268845 | A1 * | 9/2018 | Yeo | G10L 25/51 |
| 2018/0350394 | A1 * | 12/2018 | Saffran | H04R 1/1083 |
| 2019/0043518 | A1 * | 2/2019 | Li | G10L 21/0216 |

OTHER PUBLICATIONS

Harry F. Olson, Acoustical Engineering (1957), 737 pages.

Philip Cotterell, On the Theory of the Second-Order Soundfield Microphone (2002), 50 pages.

Invensense, Application Note AN-1140, Microphone Array Beamforming. Revision 1.0 (Dec. 31, 2013), 12 pages.

* cited by examiner

SPATIAL LOW-CROSSTALK HEADSET

FIELD OF THE DISCLOSURE

This disclosure relates to a method and apparatus for reducing cross-talk between transmitted audio signals and received audio in a headset.

BACKGROUND

Headsets having earphones for conveying audio signals to a wearer and/or user of the headset from one or more audio signals generators and/or speakers are known. Headsets having microphones for conveying audio signals produced by the user to one or more listeners and/or recording devices are also known.

A standard headset typically may include one or two earphones adapted to be worn by a user, such that the one or two earphones are positioned adjacent to the user's ears. Many headsets also include a microphone. The microphone may be attached to the headset such that the microphone is positioned near the user's mouth. In existing headsets, electrical wires connecting the earphones and the microphone have been housed inside a single electrical cable running between the one or more electrical connector receptacles into which the electrical cable is plugged, and the location or position where the electrical wires extend to the earphones and/or microphones. As a result, the electrical wire(s) for the earphones and the electrical wire for the microphone may be in close proximity to each other.

In prior art headsets, the microphone of the headset is attached to the headset at a position adjacent to the earphone of the headset. Typically, tube-type microphone booms have been used to facilitate positioning the microphone by the user's mouth to receive vocal audio signals.

SUMMARY

One aspect of the disclosed invention is a new headset design to reduce cross-talk. A user of the headset may be referred to as the wearer and/or the speaker, depending on context. In some implementations, the headset may reduce cross-talk between incoming earphone audio signals and outgoing microphone output audio signals. Cross-talk is a phenomenon by which a signal transmitted on one circuit, channel, or transmission system (e.g., a wire) creates an undesired effect in another circuit, channel, or transmission system. Cross-talk is usually caused by undesired electrical, acoustical, and/or mechanical (inductive, or conductive) coupling from one circuit, channel, or transmission system to another. Cross-talk may be unintentional. Isolation may be required between the incoming earphone audio signals to the headset earphone(s) and the outgoing microphone output audio signal, e.g., due to the confidential nature of the incoming signal in multi-level security applications. In some implementations, the headset may include separate audio channels going to one or more earphones. This disclosure may provide features that optimize and enhance isolation between different signals.

In some implementations, the headset may reduce cross-talk, and/or provide other enhancements. The headset may be configured to receive the incoming earphone audio signals, capture audio information, and/or transmit the outgoing microphone output audio signals. The audio information may include speaker information (i.e. audio information produced and/or generated by the speaker), ambient information, and/or other information. The headset may reduce cross-talk between audio signals, e.g., between the incoming earphone audio signals and the outgoing microphone output audio signals. In some implementations, the headset may include one or more of a set of earphones, a headset frame, a microphone boom, a VOX circuit (e.g., microphone gating circuitry), one or more cables, and/or other components.

In some implementations, the set of earphones may be configured to provide the incoming earphone audio signals to the wearer. The set of earphones may include one or more individual earphones. The set of earphones may include one, two, or more earphones. The set of earphones may include one or more of an active earphone, a passive earphone, and/or other earphones. In some implementations, the active earphone and/or the passive earphone may include noise canceling features, and/or other features. The active earphone may prevent the output audio information from being leaked into the surrounding environment. The passive earphone may prevent audio information from being leaked into the surrounding environment. In some implementations, the set of earphones may include a first earphone, a second earphone, and/or other earphones.

In some implementations, the first earphone may be coupled to the headset frame at a first earphone position. The first earphone position may be a first location on the headset frame. The first location on the headset frame may be adjacent to a first ear of the user when the user is wearing the headset. The first earphone position may be such that when the headset is worn by the user, the first earphone may be positioned adjacent to the user's first ear. The first earphone may further be positioned so that the incoming earphone audio signals can be heard by the user through the first earphone. Where the first earphone is mounted to the headset frame, dampeners may be used to reduce the mechanical coupling between the first earphone and the headset frame. Insulators may be used where the first earphone is mounted to the headset frame to reduce the electrical coupling between the first earphone and the headset frame.

In some implementations, the second earphone may be coupled to the headset frame at a second earphone position. The second earphone position may be positioned a second location on the headset frame. The second location on the headset frame may be adjacent to a second ear of the user when the user is wearing the headset. The second earphone position may be such that when the headset is worn by the user, the second earphone may be positioned adjacent to the user's second ear. The second earphone may further be positioned so that the incoming earphone audio signals can be heard by the user through the second earphone. Where the second earphone is mounted to the headset frame, dampeners may be used to reduce the mechanical coupling between the second earphone and the headset frame. Insulators may be used where the second earphone is mounted to the headset frame to reduce the electrical coupling between the second earphone and the headset frame. The second earphone position may be at an opposite side of the user's head compared to the first earphone position. In other words, the first earphone position and the second earphone position may be on opposite sides of the user's head.

In some implementations, the headset frame may be configured to securely and/or comfortably hold the headset in position on the user's head during use. The headset frame may be configured to securely carry and/or otherwise support one or more components of the headset. In some implementations, the headset frame may be configured to reduce electrical, acoustical, and/or mechanical (inductive, or conductive) coupling between the components of the headset coupled to the headset frame, including but not limited to undesired couplings. The headset frame may be configured to reduce cross-talk between the earphone audio signals and the microphone audio signals. The head frame may be configured to securely support one or more components of the headset by using one or more fasteners. The one or more fasteners may include one or more of a nail, a screw, a clasp, a clamp, an adhesive, and/or other fastening devices. The one or more fasteners may include dampeners to reduce the mechanical coupling and insulators to reduce the electrical coupling between the one or more component of the headset fastened to the headset frame.

In some implementations, the microphone boom may be configured to capture audio information. In some implementations, the microphone boom may include one or more of a boom tip, a boom body, one or more sets of microphones, and/or other components. The one or more sets of microphones may be configured to capture audio information and/or other information. In some implementations, the one or more sets of microphones may include a first set of microphones, a second set of microphones, and/or other microphones.

In some implementations, the boom tip may be configured to support and/or house one or more microphones. The boom tip may be configured to support and/or house the first set of microphones, and/or other components. In some implementations, the first set of microphones may include at least four microphones. In some implementations, the first set of microphones may be configured to capture the speaker information and/or other audio information. In some implementations, the speaker information may convey audio information generated by the user and/or other audio information.

In some implementations, the first set of microphones may include two individual microphones working as a pair of microphones. In some implementations, the first set of microphones may include multiple pairs of microphones. The one or more pairs of microphones may include a first pair of microphones, a second pair of microphones, and/or other pairs of microphones. The speaker information may be captured by the first pair of microphones, the second pair of microphones, and/or other pairs of microphones. In some implementations, the individual microphones of the individual pairs of microphones may produce opposite output signals. For example, individual microphones of an individual pair of microphones may produce a positive output signal or a negative output signal. In some implementations, the first set of microphones may generate primary audio signals based on the captured speaker information.

In some implementations, the boom body may be configured to support and/or house one or more microphones. In some implementations, the boom body may be configured to support and/or house the second set of microphones, and/or other components. In some implementations, the second set of microphones may be configured to capture ambient information and/or other audio information. In some implementations, the ambient information may convey audio information from the surroundings of the headset.

In some implementations, the second set of microphones may include one or more individual microphones. In some implementations, two individual microphones may be configured to work as a pair of microphones. In some implementations, the second set of microphones may include one or more pairs of microphones. The one or more pairs of microphones may include a third pair of microphones, and/or other pairs of microphones. The ambient information may be captured by the third pair of microphones, and/or other pairs of microphones. In some implementations, the individual microphones of individual pairs of microphones may produce opposite output signals. For example, the individual microphones of a pair of microphones may produce a positive output signal or a negative output signal. In some implementations, the second set of microphones may generate secondary audio signals based on the captured ambient information.

In some implementations, the microphone boom may include one or both of circuitry and one or more physical processors. One or both of the circuitry and the one or more physical processors may jointly be referred to as a processing element or as processing elements. The processing elements may be configured to perform one or more of the following: receive primary audio signals from a first set of microphones, receive secondary audio signals from a second set of microphones, generate a speaker signal based on the primary audio signals and/or the secondary audio signals, and/or perform other functions.

In some implementations, one or more processors may be configured by machine-readable instructions. Executing the machine-readable instructions may cause the microphone boom to capture audio information. The machine-readable instructions may include one or more computer program components. The computer program components may include one or more of a microphone audio processing component, a microphone audio generation component, and/or other components.

In some implementations, the microphone audio processing component may be configured to obtain audio signals from one or more sets of microphones. In some implementations, the microphone audio processing component may be configured to obtain audio signals from the first set of microphones, the second set of microphones, and/or other microphones. In some implementations, the audio signals obtained from the first set of microphones may include the primary audio signals and/or other audio signals. In some implementations, the audio signals obtained from the second set of microphones may include the secondary audio signals and/or other signals. In some implementations, the microphone audio processing component may be configured to combine opposite output signals of the one or more individual pairs of microphones (e.g., included in the first and/or second set of microphones). In some implementations, the microphone audio processing component may be configured to generate speaker signals.

In some implementations, the microphone audio generation component may be configured to transmit audio signals to the VOX circuit, one or more external sources, and/or other components. The microphone audio generation component may transmit the audio signals captured by the microphone boom to the VOX circuit, one or more external sources, and/or other components.

In some implementations, the VOX circuit may be configured to determine when the outgoing microphone output audio signals may be transmitted. In some implementations, the VOX circuit may be configured to determine when the outgoing microphone output audio signals of a set of microphones may be transmitted to one or more external sources and/or other components. The VOX circuit may determine when the outgoing microphone output audio signals of a set of microphones may be transmitted based on the audio information obtained from the microphone boom. The VOX circuit may determine when the outgoing microphone output audio signals of the sets of microphones may be transmitted based on captured speaker information, the ambient information, and/or other information or combinations thereof. The VOX circuit may be configured to determine whether to enable and/or disable one or more outgoing microphone output audio signals from being transmitted. The VOX circuit may determine whether to enable and/or disable the outgoing microphone output audio signals of one or more sets of microphones from being transmitted based on obtained audio information, e.g., to reduce cross-talk between different signals. In some implementations, the VOX circuit may include one or more physical processors, one or more electronic storage, and/or other components. The physical processor(s) may be configured by machine-readable instructions. Executing the machine-readable instructions may cause the VOX circuit to temporarily suppress the transmission of one or more outgoing microphone audio signals. The machine-readable instructions may include one or more computer program components. The computer program components may include one or more of an audio processing component, an audio analysis component, audio suppression component, audio generation component, and/or other components.

In some implementations, the audio processing component may be configured to combine the first primary audio signal, the second primary audio signal, and/or other audio signals. The first primary audio signal, the second primary audio signal, or other audio signals may be delayed by a particular time duration by the audio processing component before being combined. In some implementations, the audio processing component may be configured to filter a combination of audio signals including one or more of the first primary audio signal, the second primary audio signal, and/or other audio signals. The filter may include a twin-tee filter, and/or other filters.

In some implementations, the audio processing component may be configured to determine one or more audio levels. The audio processing component may determine a primary audio level based on the primary audio signal, a secondary audio level based on the secondary audio signals, and/or so forth for other audio signals.

In some implementations, the audio analysis component may be configured to determine a minimum audio threshold level, e.g., based on audio levels. In some implementations, the audio analysis component may determine a minimum audio threshold level based on one or more of the primary audio level, the secondary audio level, and/or other audio levels. In some implementations, the audio analysis component may determine a minimum audio threshold level based on a comparison between the primary audio level, the secondary audio level, and/or other audio levels. In some implementations, the minimum audio threshold level may be determined based on the secondary audio level.

In some implementations, the audio suppression component may be configured to determine when the outgoing microphone audio signals of the sets of microphones may be transmitted. In some implementations, the audio suppression component may determine whether to suppress and/or disable the transmission of one or more outgoing microphone audio signals. For example, such a determination may be based on comparisons between the primary audio level, minimum audio threshold, and/or other information. In some implementations, the audio suppression component may facilitate the resumption of the transmission and/or otherwise end the suppression of the transmission of the outgoing microphone audio signals. For example, operation by the audio suppression component may be based on comparisons between the primary audio level, minimum audio threshold, and/or other information.

In some implementations, the audio generation component may be configured to transmit the outgoing microphone audio signals to one or more external sources. In some implementations, the audio generation component may transmit the outgoing microphone audio signals to one or more external sources through a wired connection and/or a wireless connection. In some implementations, the audio generation component may transmit the outgoing microphone audio signals to the one or more external sources through the cable(s) and/or via other components.

In some implementations, the cable(s) may be configured to transfer and/or receive audio signals and/or other information. The cable(s) may be configured to transfer and/or receive audio signals between components of the headset and/or one or more external sources. In some implementations, the cable(s) may include one or more of an earphone cable, a microphone cable, and/or other cables. In some implementations, the earphone cable(s) may include one or more of a first set of twisted double shielded pairs of earphone wires, one or more earphone connectors, and/or other components. In some implementations, the microphone cable(s) may include one or more of a set of twisted double shielded pairs of wires, a set of microphone connectors, and/or other components.

In some implementations, the earphone cable(s) may be configured to carry the incoming earphone audio signals from the one or more external sources and/or other sources. The earphone cable(s) may be configured to carry the incoming earphone audio signals obtained from the one or more external sources. The incoming earphone audio signals obtained from the second external source may be carried to the headset by one or more components of the earphone cable(s). In some implementations, the first set of twisted double shielded pairs of earphone wires may provide a conductive pathway to carry the incoming earphone audio signals from the one or more external sources and/or other sources. In some implementations, the earphone connector(s) may facilitate one or more connections between the headset and one or more external sources.

In some implementations, the microphone cable(s) may be configured to carry the outgoing microphone audio signals from the headset. The microphone cable(s) may be configured to carry the outgoing microphone audio signals obtained from the headset to one or more external sources. The outgoing microphone audio signals of the headset may be carried to the first external source by one or more components of the microphone cable(s). In some implementations, the first set of twisted double shielded pairs of microphone wires may provide a conductive pathway to carry the outgoing microphone output audio signals. In some implementations, the microphone connectors may facilitate one or more connections between the headset and one or more external sources.

In some implementations, the earphone cables and the microphone cable(s) may be separated by at least a predetermined distance, for at least part of the entire length of these cables. The earphone cables and the microphone cable(s) may be separated by a predetermined distance to reduce electrical, acoustical, and mechanical coupling. In some implementations, the earphone cables and the microphone cable(s) may be separated for the entire length of at least one of the cables. In some implementations, the earphone cables and the microphone cable(s) may be separated for at least 1, 2, 3, 4, 5, 6, or more feet along the length of these cables.

These and other features, and characteristics of the present technology, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of "a," "an," and "the" include plural referents unless the context clearly dictates otherwise.

DETAILED DESCRIPTION

Figure 1:
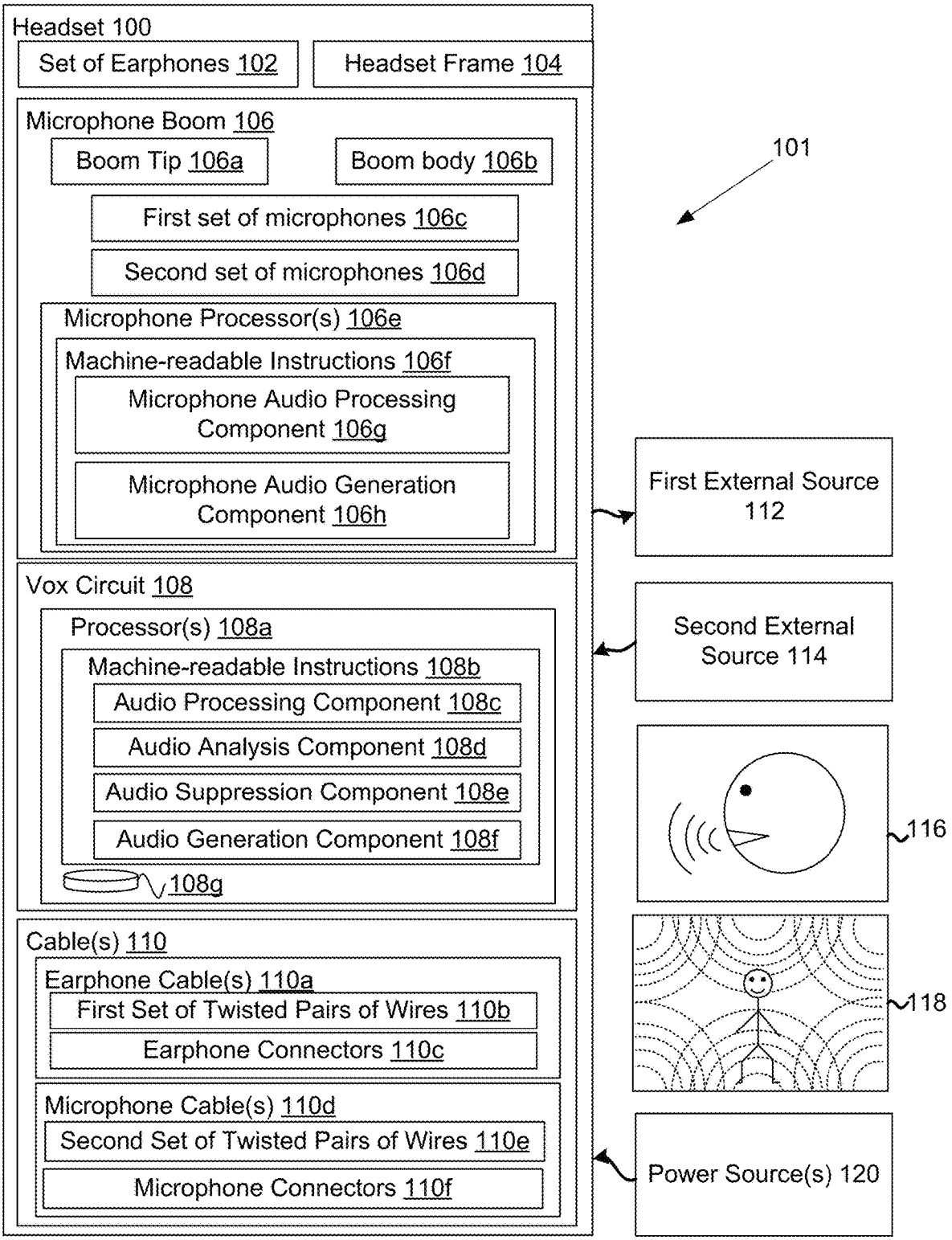
FIG. 1 illustrates the system of the headset configured to substantially cross-talk between the incoming earphone audio signals and the outgoing microphone output audio signals, in accordance with one or more embodiments.
Figure 2:
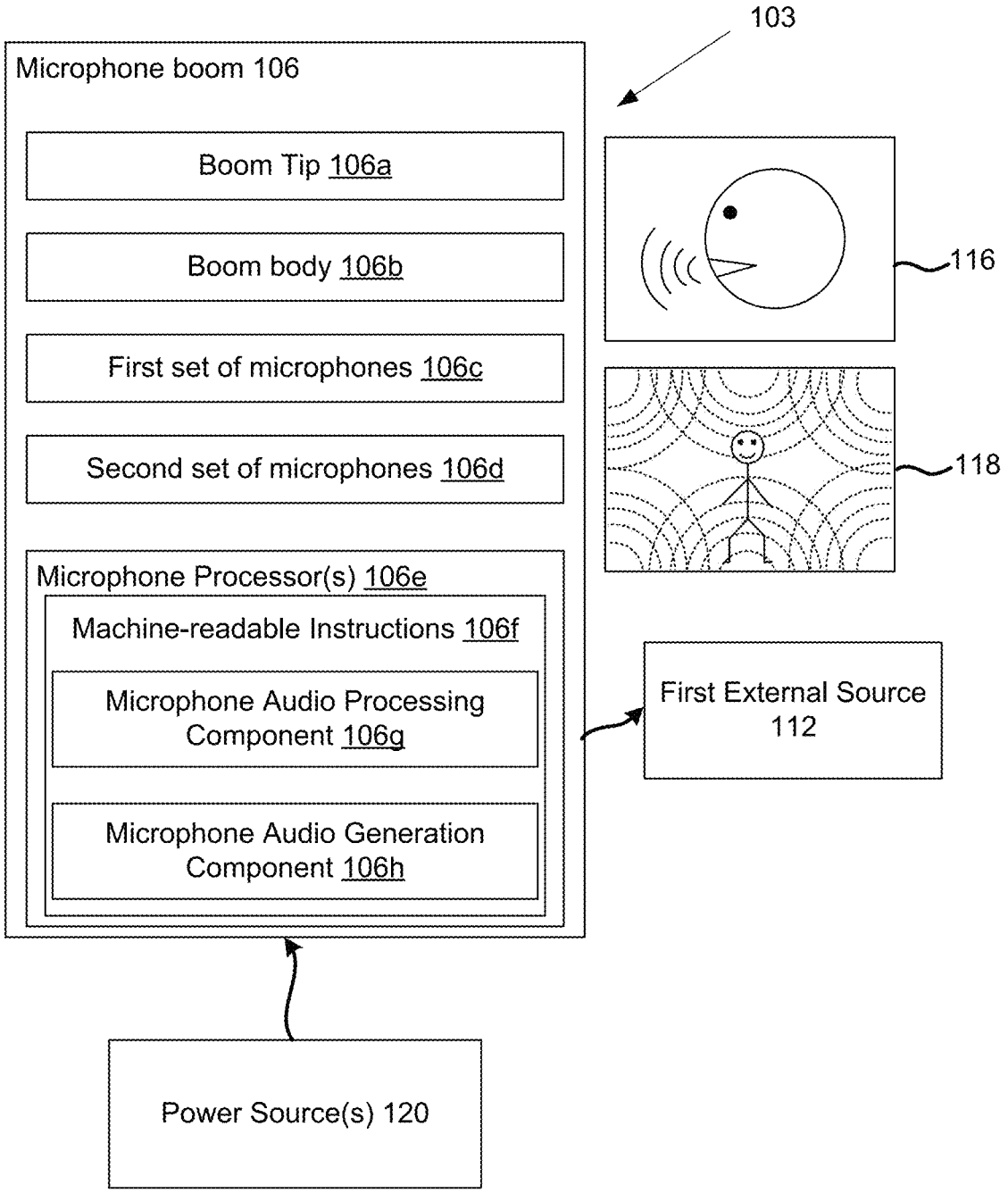
FIG. 2 illustrates the microphone boom system of the headset, in accordance with one or more embodiments.

FIG. 1 illustrates a system 101 for a headset 100 reduce cross-talk, and/or provide other enhancements. Headset 100 may reduce cross-talk, e.g., between the incoming earphone audio signals and the outgoing microphone output audio signals. In some implementations, system 101 includes one or more of headset 100, one or more external sources, one or more power sources 120, audio information, and/or other components. The one or more external sources may include a first external source 112, a second external source 114, and/or other external sources. The audio information may include speaker information 116 (i.e., audio information produced and/or generated by the speaker), ambient information 118, and/or other information. Headset 100 may include one or more of a set of earphones 102, a headset frame 104, a microphone boom 106, a VOX circuit 108 (e.g., a microphone gating circuitry/circuit), one or more cable(s) 110, and/or other components.

In some implementations, headset 100 may obtain and/or otherwise receive incoming earphone audio signals. For example, headset 100 may obtain incoming earphone audio signals from one or more external sources and/or other sources. In some implementations, headset 100 may obtain the incoming earphone audio signals from the one or more external sources through cable(s) 110. Headset 100 may obtain the incoming earphone audio signals from second external source 114 and/or other external sources. Second external source 114 may be configured to transmit the incoming earphone audio signals to headset 100 and/or other information.

In some implementations, headset 100 may transmit outgoing microphone output audio signals. Headset 100 may transmit outgoing microphone output audio signals to the one or more external sources and/or other sources. In some implementations, headset 100 may transmit the outgoing microphone output audio signals to the one or more external sources through cable(s) 110. Headset 100 may transmit the outgoing microphone output audio signals to first external source 112 and/or other external sources. First external source 112 may be configured to receive the outgoing microphone output audio signals from headset 100 and/or other information.

In some implementations, headset 100 may be configured to reduce cross-talk between the outgoing microphone output audio signals and the incoming earphone audio signals. Headset 100 may be configured to reduce cross-talk between the outgoing microphone output audio signals and the incoming earphone audio signals. Headset 100 may reduce cross-talk between the outgoing audio signals transmitted to the one or more external sources and the incoming earphone audio signals received from the one or more external sources using one or more components of headset 100.

Figure 5A:
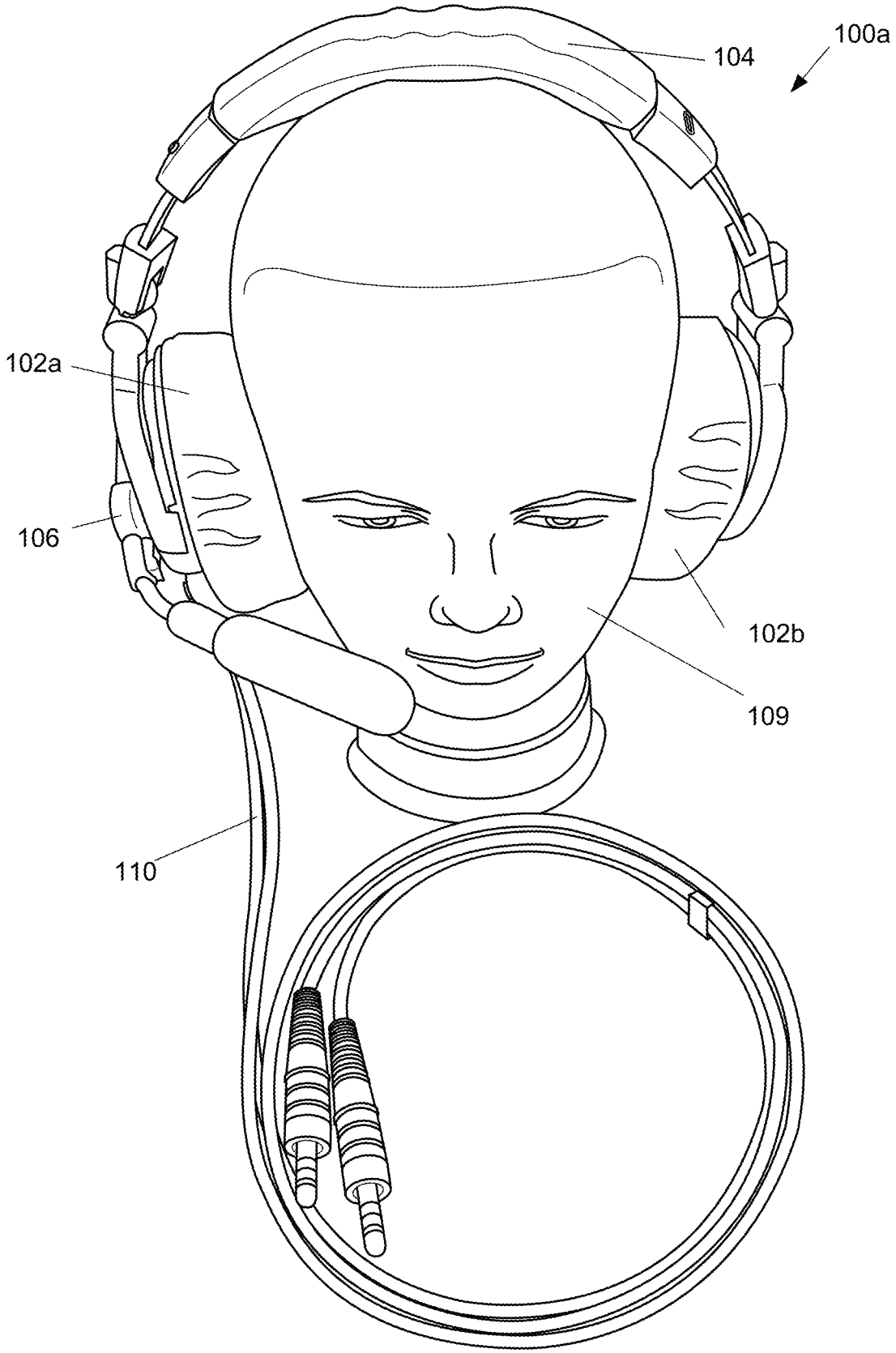
FIG. 5A illustrates a front view of the headset being secured to the user's head.

In some implementations, set of earphones 102 may be configured to provide the incoming earphone audio signals to a user of headset 100. The user of the headset may be referred to as the wearer and/or the speaker, depending on context. Set of earphones 102 may include one or more individual earphones. Set of earphones 102 may include one, two, or more earphones. Set of earphones 102 may include a first earphone 102*a*, a second earphone 102*b* (as illustrated in FIG. 5A), and/or other earphones. Individual earphones of set of earphones 102 may be configured to generate output audio information and/or other information based on the incoming earphone audio signals. Individual earphones of set of earphones 102 may be configured to generate output audio information such that the incoming earphone audio signals can be heard by the user when the user is wearing headset 100.

In some implementations, set of earphones 102 may include one or more of an active earphone, a passive earphone, and/or other earphones. An active earphone may include active noise canceling features, and/or other features. An active earphone may prevent the output audio information from being leaked into the surrounding environment. In some implementations, a passive earphone may be a conventional earphone and/or other earphones. A passive earphone may include passive noise canceling features, and/or other features. A passive earphone may prevent audio information from being leaked into the surrounding environment. In some implementations, individual earphones of set of earphones 102 may include one or more of an around-the-ear earphone, an on-ear earphone, an earbud, an in-ear earphone, a small on-ear earphone, and/or other earphones. In some implementations, set of earphones 102 may be configured to reduce cross-talk by reducing the output audio information for the user of headset 100 from being leaked into the surrounding environment.

In some implementations, headset frame 104 may be configured to securely and/or comfortably hold headset 100 in position on the user's head during use. Headset frame 104 may be configured to securely support one or more component of headset 100. In some implementations, headset frame 104 may be configured to reduce electrical, acoustical, and/or mechanical (inductive, or conductive) coupling between the components of headset 100 coupled to headset frame 104. Headset frame 104 may be configured to reduce cross-talk between the incoming earphone audio signals and the outgoing microphone output audio signals.

In some implementations, head frame 104 may be configured to securely support one or more components of headset 100 by using one or more fasteners. The one or more fasteners may include dampeners to reduce the mechanical coupling and insulators to reduce the electrical coupling between the one or more components of headset 100 coupled to headset frame 104.

In some implementations, headset frame 104 may be flexible to facilitate bending of headset frame 104. The bending of headset frame 104 may shape headset frame 104 to the user's head and/or other users' head. Headset frame 104 may be shaped in a U-shape to facilitate bending of headset frame 104. Headset frame 104 may be adjustable to allow different users having different-sized heads to use headset 100. In some implementations, portions of headset frame 104 may be extended and/or retracted to allow adjustment of headset frame 104.

In some implementations, headset frame 104 may include an elasticated material and/or other materials. The elasticated material may include one or more of a metal, a plastic, and/or other materials. The elasticated material may allow headset 104 to be flexible. In some implementations, headset frame 104 may be configured to produce pressure against the user's head when worn so that headset 100 may be secured to the user's head. The elasticated material and the shape of headset frame 104 may help facilitate the application of pressure against the user's head.

As is illustrated in FIG. 5A, headset frame 104 may be configured to securely and comfortably hold headset 100 in position on user 109's head during use. Headset frame 104 may be configured to securely support one or more component of headset 100. For example, headset frame 104 may securely support first earphone 102*a*, second earphone 102*b*, microphone boom 106, one or more cable(s) 110, and/or other components of headset 100. In some implementations, headset frame 104 may be shaped to fit user 109's head. In some implementations, headset frame 104 may be configured to produce pressure against user 109's head so that headset 100 may be secured on user 109's head.

Referring to FIG. 1, in some implementations, set of earphones 102 may be coupled to headset frame 104. In some implementations, set of earphones 102 may be coupled to headset frame 104 such that when headset 100 is worn by the user, the individual earphones of set of earphones 102 may be positioned adjacent to an ear of the user so that the incoming earphone audio signals may be heard by the user through set of earphones 102. In some implementations, dampeners may be used to reduce the mechanical coupling between set of earphones 102 and headset frame 104 where set of earphones 102 may be mounted to headset frame 104. Insulators may be used to reduce the electrical coupling between set of earphones 102 and headset frame 104 where set of earphones 102 may be mounted to headset frame 104.

Referring to FIG. 5A, in some implementations, first earphone 102*a* may be coupled to headset frame 104 at a first earphone position. The first earphone position may be a first location on headset frame 104. The first location on headset frame 104 may be adjacent to a first ear of user 109 when user 109 is wearing headset 100. The incoming earphone audio signals may be heard by user 109 through first earphone 102*a* at the first earphone position. The first earphone position may be such that when headset 100 is worn by the user, first earphone 102*a* may be positioned adjacent to the user's first ear and may further be positioned so that the incoming earphone audio signals can be heard by the user through first earphone 102*a*. Where first earphone 102*a* mounts to headset frame 104 of headset 100, dampeners may be used to reduce the mechanical coupling between first earphone 102*a* and headset frame 104. Insulators may be used where first earphone 102*a* mounts to headset frame 104 to reduce the electrical coupling between first earphone 102*a* and headset frame 104.

In some implementations, second earphone 102*b* may be coupled to headset frame 104 at a second earphone position. The second earphone position may be a second location on headset frame 104. The second location on headset frame 104 may be adjacent to a second ear of user 109 when user 109 is wearing headset 100. The incoming earphone audio signals may be heard by user 109 through second earphone 102*b* at the second earphone position. The second earphone position may be such that when the headset is worn by the user, second earphone 102*b* may be positioned adjacent to the user's second ear and may further be positioned so that the incoming earphone audio signals can be heard by the user through second earphone 102*b*. Where second earphone 102*b* is mounted to headset frame 104, dampeners may be used to reduce the mechanical coupling between second earphone 102*b* and headset frame 104. Insulators may be used where second earphone 102*b* is mounted to headset frame 104 to reduce electrical coupling between second earphone 102*b* and headset frame 104. The second earphone position may be at an opposite side of the user 109's head compared to the first earphone position. The earphone position and the second earphone position may be on opposite sides on the user's head.

Figure 8A:
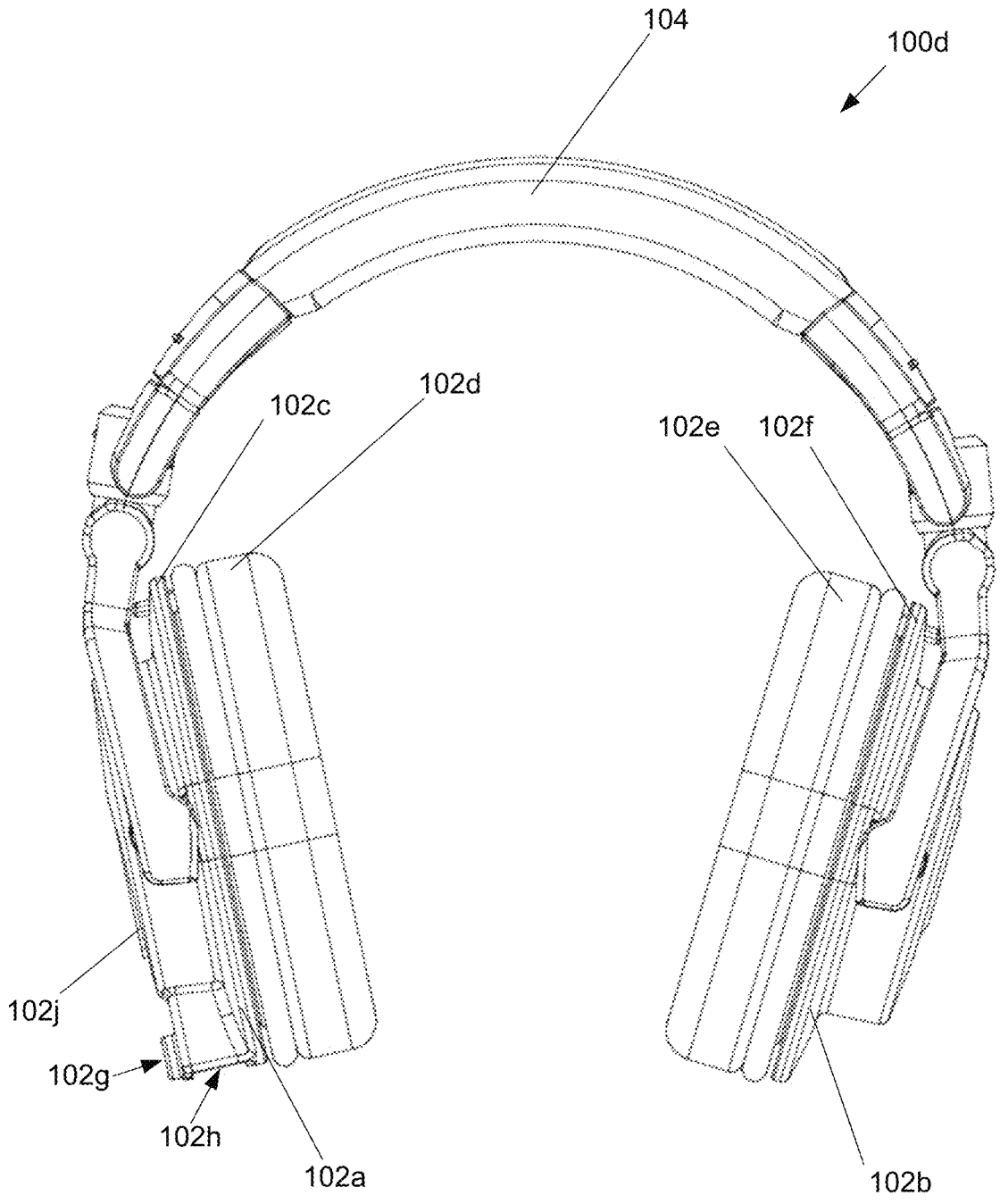
FIG. 8A illustrates a front view of the headset without the cable and microphone boom attached.

Referring to FIG. 8A, in some implementations, first earphone 102*a* may include one or more of an earpad 102*d*, a speaker 102*c*, a cable coupling receptacle 102*h*, a cable fastening receptacle 102*g*, a microphone receptacle 102*j*, and/or other components. In some implementations, earpad 102*d* may be configured to go around an ear of the user when headset 100 is worn. Earpad 102*d* may include noise isolation features and/or other features. In some implementations, speaker 102*c* may be configured to output the incoming audio information. In some implementations, cable coupling receptacle 102*h* may be configured to receive cable(s) 110. Cable coupling receptacle 102*h* may be configured to facilitate the reception of the incoming earphone audio signals from the one or more external sources, and/or the transmission outgoing microphone output audio signals to the one or more external source. In some implementations, cable fastening receptacle 102*g* may be configured to fasten cable(s) 110 to first earphone 102*a* by one or more couplers. In some implementations, microphone receptacle 102*j* may be configured to facilitate transmission of the audio information captured by microphone boom 106 to other components of headset 100.

In some implementations, second earphone 102*b* may include the same components as first earphone 102*a*. In some implementations, second earphone 102*b* may include one or more of an earpad 102*e*, a speaker 102*f*, and/or other components. In some implementations, earpad 102*e* may be configured to go around the ear the user when headset 100 is worn. Earpad 102*e* may include noise isolation features and/or other features. In some implementations, speaker 102*f* may be configured to output the incoming audio information.

Referring to FIG. 1, in some implementations, microphone boom 106 may be configured to capture audio information. In some implementations, microphone boom 106 include one or more of a boom tip 106*a*, a boom body 106*b*, one or more sets of microphones, one or both of circuitry and one or more microphone processor(s) 106*e*, and/or other components. One or both of the circuitry and the one or more microphone processor(s) 106*e* may jointly be referred to as a processing element or as processing elements. In some implementations, the one or more sets of microphones may include a first set of microphones 106*c*, a second set of microphones 106*d*, and/or other microphones.

In some implementations, the processing elements may be configured to perform one or more of the following: receive primary audio signals from the first set of microphones, receive the secondary audio signals from the second set of microphones, generate a speaker signal based on the primary audio signals and/or the secondary audio signals, and/or perform other functions. The speaker signal may represent the audio information from the user, and/or other information.

Figure 5B:
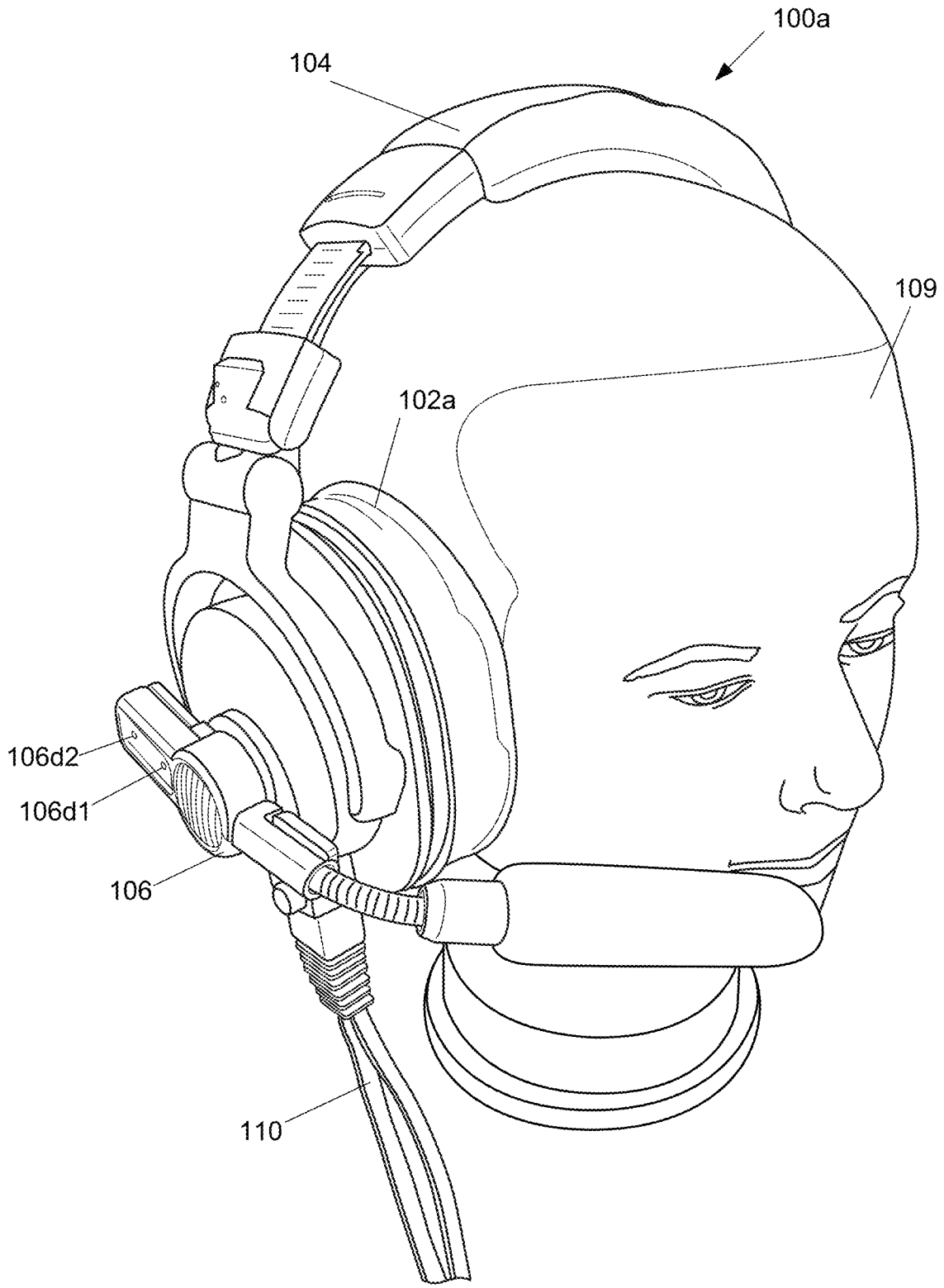
FIG. 5B illustrates a side view of the headset being secured to the user's head.

In some implementations, microphone boom 106 may be coupled to headset frame 104, set of earphones 102, and/or other components. In some implementations, microphone boom 106 may be coupled to first earphone 102*a* (e.g., as illustrated in FIG. 5B). Microphone boom 106 may be coupled with the one or more couplers and/or fasteners. Microphone boom 106 may include a proximal end near the coupling and a distal end opposite the proximal end.

In some implementations, boom tip 106*a* may be coupled to boom body 106*b* and/or other components of headset 100. Boom tip 106*a* may be coupled to boom body 106*b* by the one or more couplers. In some implementations, boom tip 106*a* may be coupled to a boom bridge. Boom tip 106*a* may be coupled to the boom bridge by the one or more couplers. The boom bridge may be coupled to boom body 106*b*. The boom bridge may be coupled to boom body 106*b* by the one or more couplers. In some implementations, the boom bridge may be flexible, rigid, and/or a combination of both. The boom bridge may include the elasticated material and/or other materials. The boom bridge may be adjusted so that the position of boom tip 106*a* may be adjusted relative to boom body 106*b*. In some implementations, boom tip 106*a* may be arranged at or near the distal end of microphone boom 106.

As is illustrated in FIG. 5B, in some implementations, boom tip 106*a* may be coupled to a boom bridge 106*i*. Boom tip 106*a* may be coupled to boom bridge 106*i* by the one or more couplers. Boom bridge 106*i* may be coupled to boom body 106*b*. Boom bridge 106*i* may be coupled to boom body 106*b* by one or more couplers. In some implementations, boom bridge 106*i* may be flexible and/or rigid. Boom bridge 106*i* may include the elasticated material and/or other materials. Boom bridge 106*i* may be adjusted so that the position of boom tip 106*a* may be adjusted relative to boom body 106*b*. In some implementations, boom tip 106*a* may be arranged at or near the distal end of microphone boom 106.

Still referring to FIG. 5B, in some implementations, boom body 106*b* may be positioned around the ear of user 109. Boom body 106 may be positioned over the first earphone 102*a*. In some implementations, boom tip 106*a* may be positioned around the month of user 109. In some implementations, boom bridge 106*i* may be adjusted so that boom tip 106*a* may be positioned around the month of user 109.

Figure 9A:
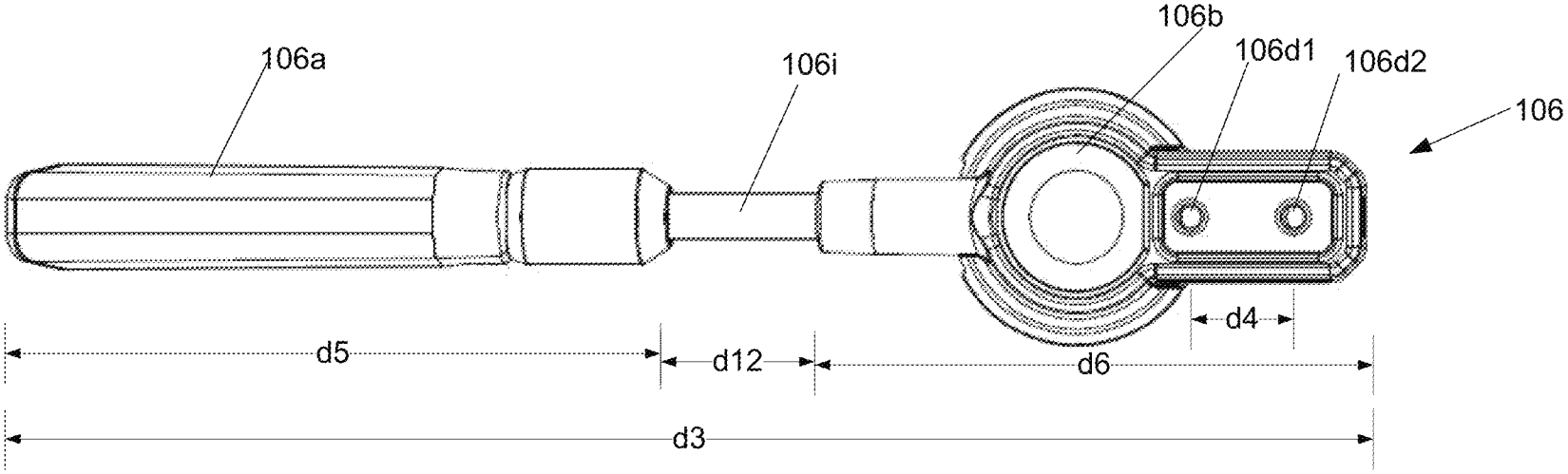
FIG. 9A illustrates a front view of the microphone boom.
Figure 9B:
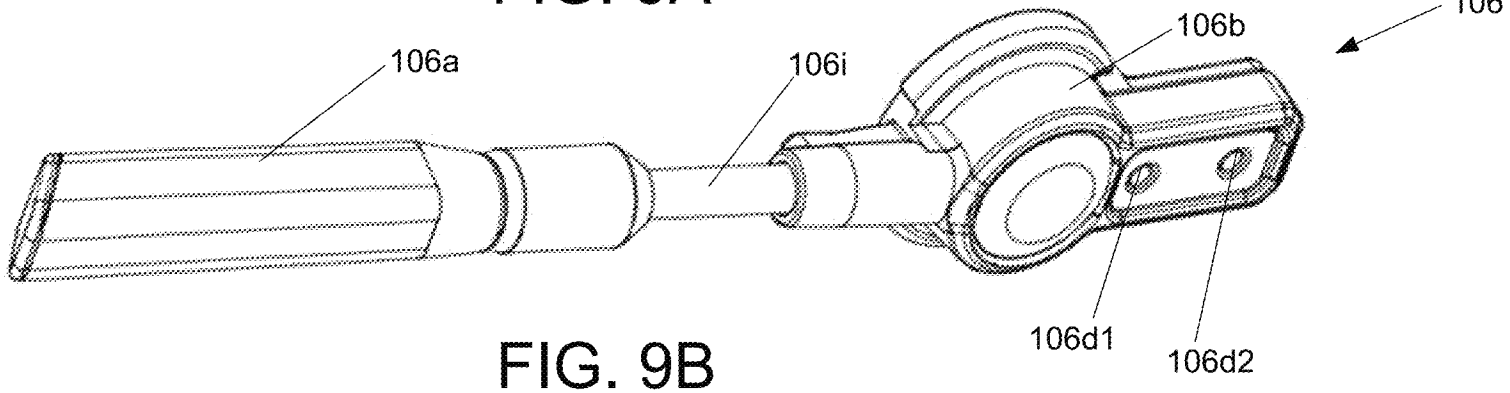
FIG. 9B illustrates a first isometric view of the microphone boom.
Figure 9C:
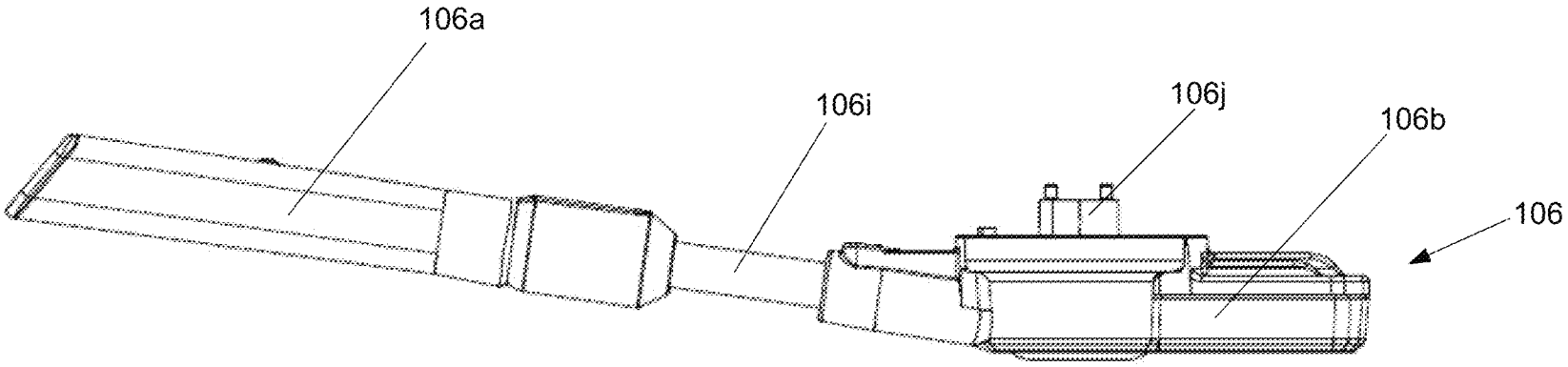
FIG. 9C illustrates a top view of the microphone boom.

Referring to FIG. 9A, in some implementations, microphone boom 106 may have a length d3. In some implementations, length d3 may be range between 150 mm to 250 mm, and/or other lengths. In some implementations, length d3 may range between 175 mm to 225 mm, and/or other lengths. In some implementations, length d3 may range between 185 mm to 215 mm, and/or other lengths. In some implementations, length d3 may range between 190 mm to 205 mm, and/or other lengths. In some implementations, length d3 may range between 183 mm to 203 mm, and/or other lengths. Boom tip 106*a* may have a length d6. In some implementations, length d6 may be range between 55 mm to 100 mm, and/or other lengths. In some implementations, length d6 may range between 65 mm to 85 mm, and/or other lengths. In some implementations, length d6 may range between 70 mm to 80 mm, and/or other lengths. In some implementations, length d6 may range between 75.5 mm to 79.5 mm, and/or other lengths. Boom body 106*b* may have a length d5. In some implementations, length d5 may range between 70 mm to 120 mm, and/or other lengths. In some implementations, length d5 may range between 80 mm to 110 mm, and/or other lengths. In some implementations, length d5 may range between 90 mm to 100 mm, and/or other lengths. In some implementations, length d5 may range between 92 mm to 98 mm, and/or other lengths. Boom bridge 106*i* may have a length d12. In some implementations, length d12 may range between 10 mm to 30 mm, and/or other lengths. In some implementations, length d12 may range between 15 mm to 25 mm, and/or other lengths. In some implementations, length d12 may range between 14.5 mm to 24.5 mm, and/or other lengths.

Referring to FIG. 1, in some implementations, the microphones may be configured to be electronically coupled to a microphone board (such as the processing element(s), VOX circuit 108, and/or other components). In some implementations, the microphone board and the individual microphones may be mounted in a floating suspension in a flexible rubber tip (not illustrated in the figures). The rubber tip may be configured to reduce mechanical audio noise.

In some implementations, boom tip 106*a* may be configured to support and/or house one or more microphones. Boom tip 106*a* may be configured to support and/or house first set of microphones 106*c*, and/or other components. In some implementations, first set of microphones 106*c* may include at least four microphones. In some implementations, first set of microphones 106*c* may include a first microphone, a second microphone, a third microphone, a fourth microphone, and/or other microphones. In some implementations, first set of microphones 106*c* may be configured to capture audio information and/or other information. First set of microphones 106*c* may generate audio signals based on the captured audio information and/or other information.

In some implementations, first set of microphones 106*c* may be configured to capture speaker information 116 and/or other audio information. Speaker information 116 may convey audio information from the speaker and/or other audio information. The audio signals generated by first set of microphones 106*c* based on speaker information 116 and/or other information may be referred to as the primary audio signals.

Figure 6A:
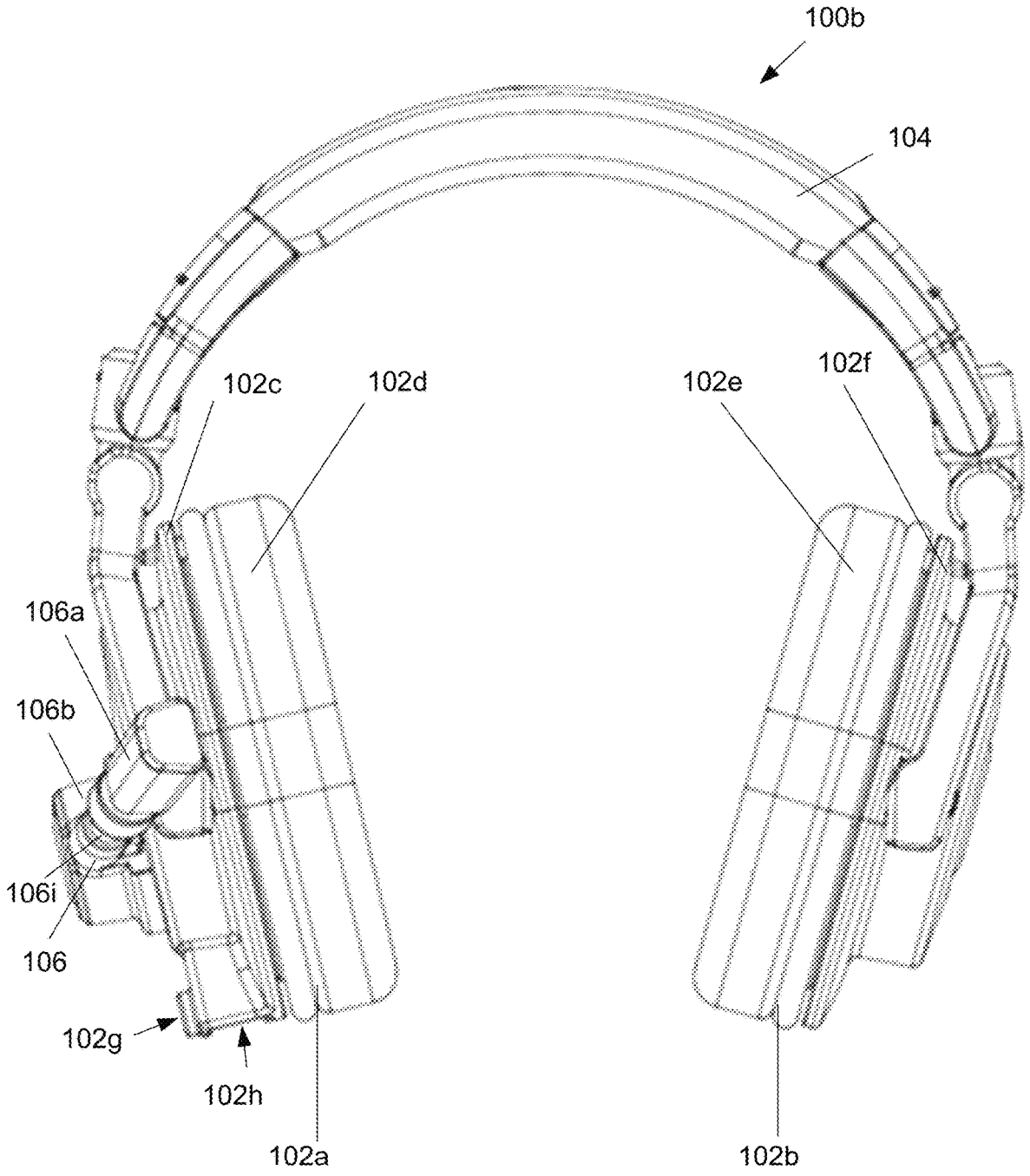
FIG. 6A illustrates a front view of the headset without the cable attached.
Figure 6B:
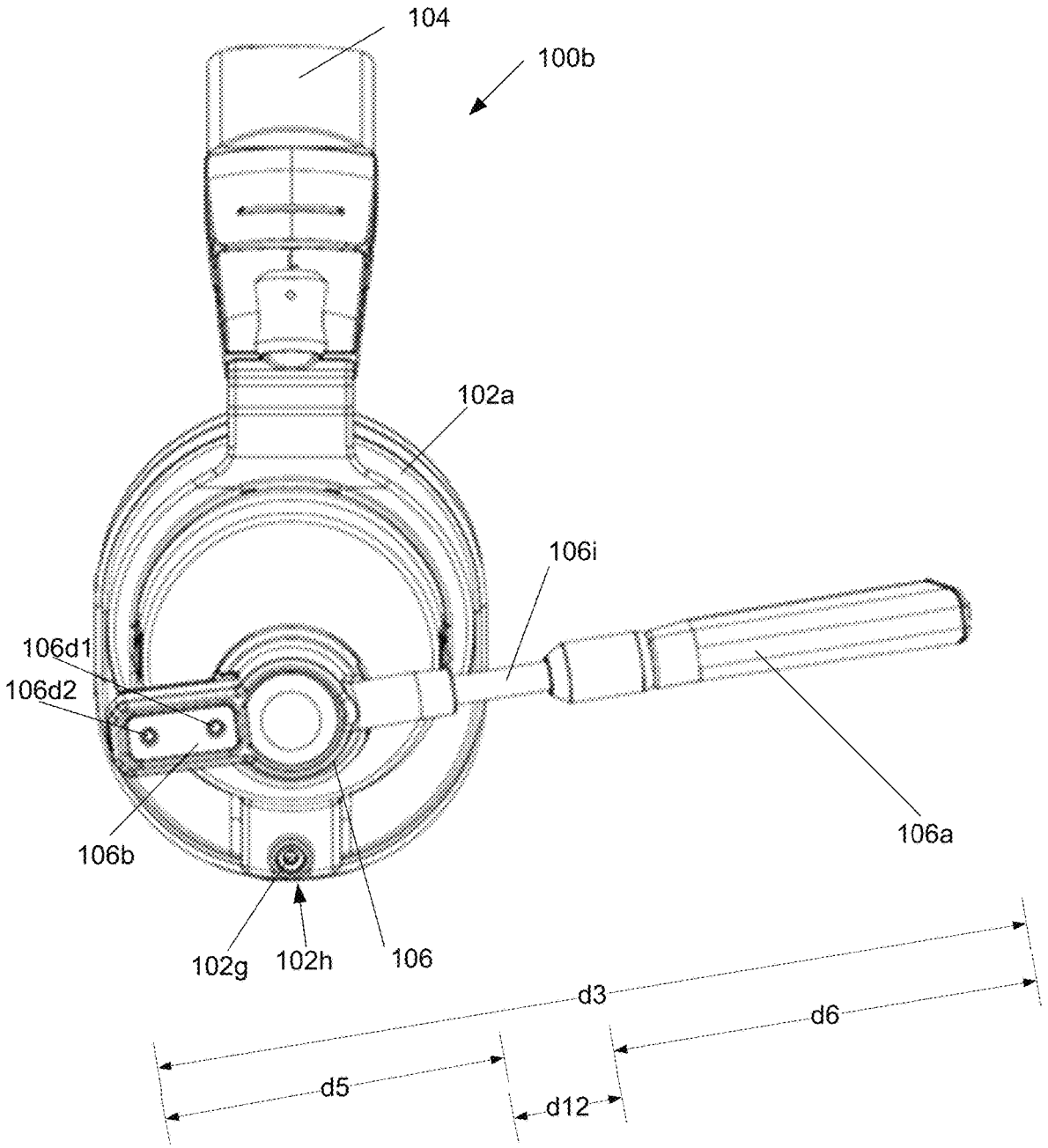
FIG. 6B illustrates a left side view of the headset without the cable attached.
Figure 6C:
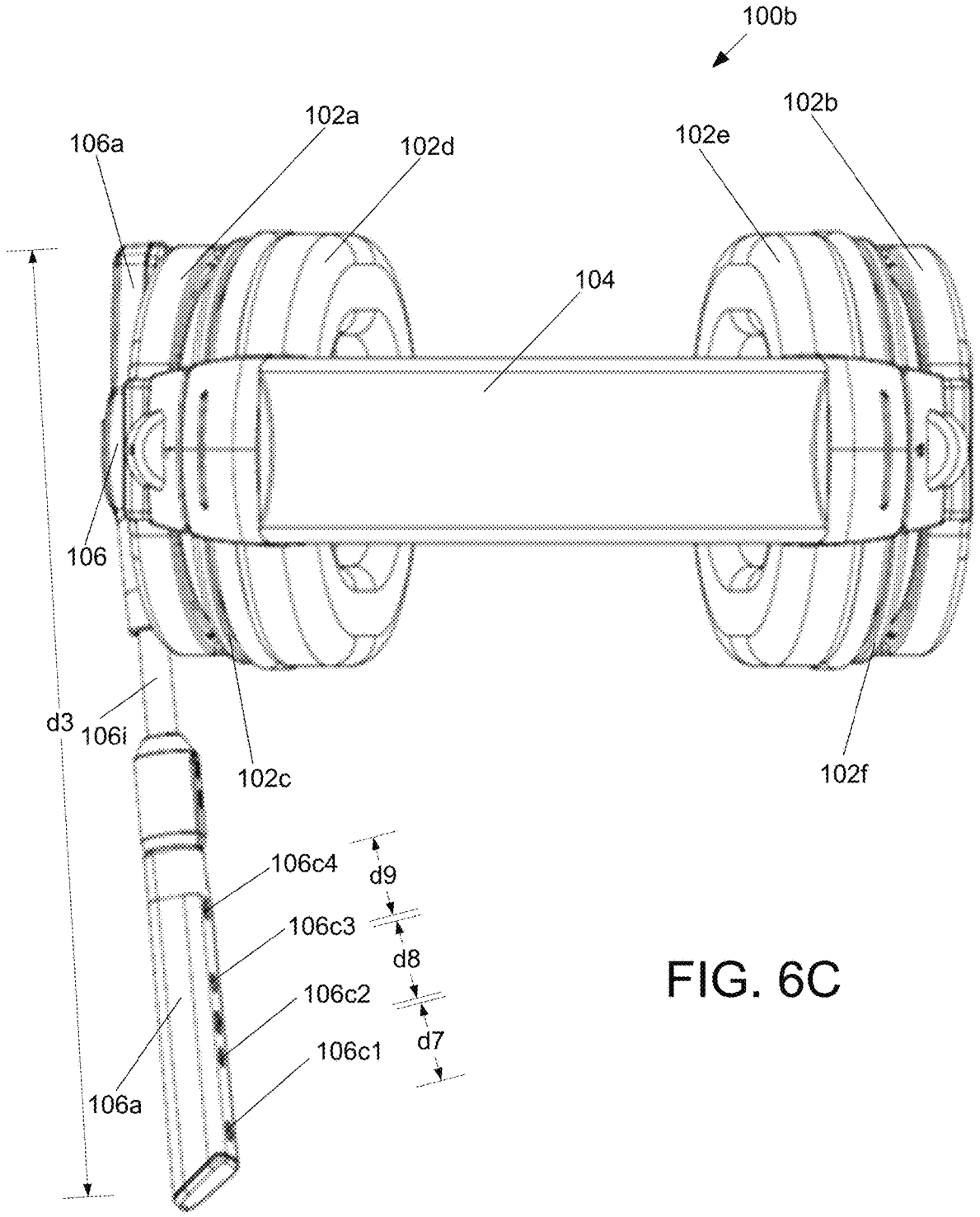
FIG. 6C illustrates a top side view of the headset without the cable attached.

Referring to FIG. 6C, in some implementations, first set of microphones 106*c* may include a first microphone 106*c*1, a second microphone 106*c*2, a third microphone 106*c*3, a fourth microphone 106*c*4, and/or other microphones. In some implementations, first set of microphones 106*c* may be configured to capture speaker information 116 and/or other audio information. Speaker information 116 may convey audio information from the speaker and/or other audio information.

Referring to FIG. 1, in some implementations, the audio information captured by individual microphones included in first set of microphones 106*c* may be different. The audio information captured by the individual microphones from first set of microphones 106*c* may be different versions of the same or similar audio information. The audio information captured by an individual microphone from first set of microphones 106*c* may be different because the audio information arrives at the individual microphones at different moments in time. The audio signals difference may be compensated for by the processing element(s), VOX circuit 108, and/or other components.

For example, referring to FIG. 6C, when first microphone 106*c*1 is closer to an audio source compared to second microphone 106*c*2, the audio information captured by first microphone 106*c*1 and second microphone 106*c*2 may be different. For example, the audio information captured by second microphone 106*c*2 may be delayed in time compared to the audio information captured by first microphone 106*c*1. The audio signals difference may be compensated for by the processing element(s), VOX circuit 108, and/or other components.

Referring to FIG. 1, in some implementations, first set of microphones 106*c* may include two individual microphones working as a pair of microphones. In some implementations, the first set of microphones may include multiple pairs of microphones. The one or more pairs of microphones may include a first pair of microphones, a second pair of microphones, and/or other pairs of microphones. Speaker information 116 may be captured by the first pair of microphones, the second pair of microphones, and/or other pairs of microphones. The audio information obtained by the first pair of microphones may be referred to as a first primary audio signal. The audio information obtained by the second pair of microphones may be referred to as a second primary audio signal. The primary audio signals may include the first primary audio signal, the second primary audio signal, and/or other audio signals. In some implementations, the first pair of microphones may include a first microphone, a second microphone, and/or other microphones, as illustrated for example in FIG. 6C. In some implementations, the second pair of microphones may include a third microphone, a fourth microphone, and/or other microphones, as illustrated for example in FIG. 6C.

Referring to FIG. 1, in some implementations, the individual microphones of the one or more individual pairs of microphones of first set of microphones 106*c* may produce opposite output signals. For example, individual microphones of the individual pairs of microphones may produce a positive output signal or a negative output signal. In some implementations, the first microphone may generate a negative output signal and/or other output signals. In some implementations, the second microphone may generate a positive output signal and/or other output signals. The negative output signal of the first microphone and the positive output signal of the second microphone may be combined to create the first primary audio signal. The negative output signal of the first microphone and the positive output signal of the second microphone may be combined by microphone audio processing component 106*g*. In some implementations, the individual microphones of the second pair of microphones may have opposite output signals. In some implementations, the third microphone may generate a positive output signal and/or other output signals. In some implementations, the fourth microphone may generate a negative output signal and/or other output signals. The positive output signal of the third microphone and the negative output signal of the fourth microphone may be combined to create the second primary audio signal. The positive output signal of the third microphone and the negative output signal of the fourth microphone may be combined by microphone audio processing component 106*g*.

In some implementations, the first pair of microphones and second pair of microphones may be arranged at the distal end of microphone boom 106. The second pair of microphones may be arranged near the distal end of microphone tip 106*a*. The first pair of microphones may be arranged at the proximal end of microphone tip 106*a*. The first pair of microphones may be arranged next to the second pair of microphones. The first pair of microphones may be arranged closer to the proximal end of microphone boom 106 than the second pair of microphones.

Referring to FIG. 6C, the first pair of microphones may include first microphone 106*c*1, second microphone 106*c*2, and/or other microphones. The second pair of microphones may include third microphone 106*c*3, fourth microphone 106*c*4, and/or other microphones. In some implementations, the individual microphones of the first pair of microphones may have opposite output signals. For example, first microphone 106*c*1 may generate a negative output signal and/or other output signals. Second microphone 106*c*2 may generate a positive output signal and/or other output signals. In some implementations, the negative output signal of first microphone 106*c*1 and the positive output signal of second microphone 106*c*2 may be combined to create the first primary audio signal. The negative output signal of first microphone 106*c*1 and the positive output signal of second microphone 106*c*2 may be combined by microphone audio processing component 106*g*. In some implementations, the individual microphones of the second pair of microphones may have opposite output signals. For example, third microphone 106*c*3 may generate a positive output signal and/or other output signals. Fourth microphone 106*c*4 may generate a negative output signal and/or other output signals. The positive output signal of third microphone 106*c*3 and the negative output signal of fourth microphone 106*c*4 may be combined to create the second primary audio signal. The positive output signal of third microphone 106*c*3 and the negative output signal of fourth microphone 106*c*4 may be combined by microphone audio processing component 106*g*.

Referring to FIG. 1, in some implementations, individual microphones of the first set of microphones 106*c* may be arranged around boom tip 106*a*, and/or other components. In some implementations, first set of microphones 106*c* may be arranged in a first line along a first side of boom tip 106*a*. The first side of boom tip 106*a* may be a side of boom tip 106*a* facing the user when headset 100 is worn by the user. The first side of boom tip 106*a* may be a side of boom tip 106*a* facing user 109 when headset 100 is worn by user 109 (as illustrated in FIG. 5B).

In some implementations, boom tip 106*a* may include vibration damping material. In some implementations, boom tip 106*a* may be made of vibration damping material. In some implementations, the vibration damping material may be configured to dampen the audio signals and reduce mechanical coupling between boom tip 106*a* and other components of headset 100. In some implementations, the vibration damping material may be configured to dampen cross-talk. In some implementations, the vibration damping material may include one or more of plastics, rubbers, metals, woods, and/or other materials.

In some implementations, boom body 106*b* may be configured to support and/or house one or more microphones. In some implementations, boom body 106*b* may be configured to support and/or house second set of microphones 106*d*, and/or other components. In some implementations, second set of microphones 106*d* may include at least two microphones. In some implementations, second set of microphones 106*d* may include a fifth microphone, a sixth microphone, and/or other microphones. In some implementations, the second set of microphones may be configured to capture audio information and/or other information. The second set of microphones may generate audio signals based on the captured audio information and/or other information.

In some implementations, the second set of microphones may be configured to capture ambient information 118 and/or other audio information. Ambient information 118 may convey audio information from the surroundings of headset 100. The audio signals generated by second set of microphones 106*d* based on ambient information 118 and/or other information may be referred to as the secondary audio signal.

In some implementations, the audio information captured by the individual microphone from second set of microphones 106*d* may be different. The audio information captured by individual microphones from second set of microphones 106*d* may be different because the audio information arrives at different moments in time. The audio signals difference may be compensated for by the processing element(s), VOX circuit 108, and/or other components.

For example, referring to FIG. 5B, second set of microphones 106*d* may include a fifth microphone 106*d*1, a sixth microphone 106*d*2, and/or other microphones. When fifth microphone 106*d*1 is closer to an audio source compared to sixth microphone 106*d*2, the audio information captured by fifth microphone 106*d*1 and sixth microphone 106*d*2 may be different. For example, the audio information captured by sixth microphone 106*d*2 may be delayed in time compared to the audio information captured by fifth microphone 106*d*1. The audio signals difference may be compensated by the processing element(s), VOX circuit 108, and/or other components.

Referring to FIG. 1, in some implementations, second set of microphones 106*d* may include two or more individual microphones. The two or more individual microphones may be configured to work as one or more pairs of microphones. The one or more pairs of microphones may include a third pair of microphones, and/or other pairs of microphones. The audio signals obtained by the third pair of microphones may be referred to as a first secondary audio signal. Ambient information 118 may be captured by the third pair of microphones, and/or other pairs of microphones. The secondary audio signals may include the first secondary audio signals and/or other audio signals. In some implementations, the third pair of microphones may include the fifth microphone, the sixth microphone, and/or other microphones. In some implementations, the third pair of microphones may be arranged at the proximal end of microphone boom 106 (or in the proximity of headset frame 104). The third pair of microphones may be arranged at the proximal end of boom body 106*b*.

In some implementations, the individual microphones of the one or more individual pairs of microphones of second set of microphones 106*d* may produce opposite output signals. For example, individual microphones of the individual pairs of microphones may produce a positive output signal or a negative output signal. In some implementations, the individual microphones of the third pair of microphones may have opposite output signals. For example, the fifth microphone may generate a positive output signal and/or other output signals. The sixth microphone may generate a negative output signal and/or other output signals. The positive output signal of the fifth microphone and the negative output signal of the sixth microphone may be combined to create the first secondary audio signal. The positive output signal of the fifth microphone and the negative output signal of the sixth microphone may be combined by microphone audio processing component 106*g*.

Figure 7A:
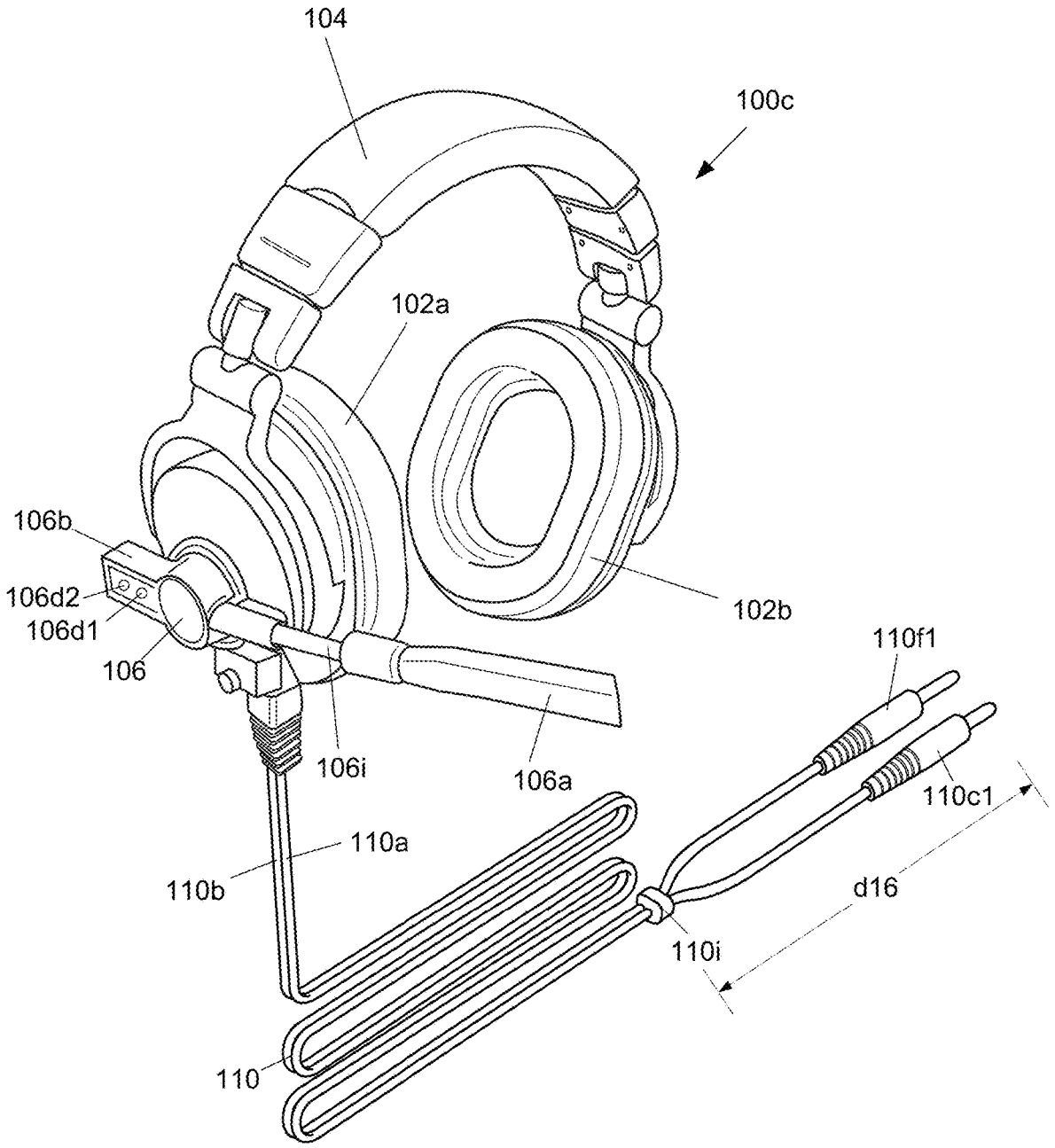
FIG. 7A illustrates an isometric view of the headset with the cable attached.

Referring to FIG. 7A, the third pair of microphones include fifth microphone 106*d*1, sixth microphone 106*d*2, and/or other microphones. The individual microphones of the third pair of microphones may produce opposite output signals. For example, fifth microphone 106*d*1 may generate a positive output signal and/or other output signals. Sixth microphone 106*d*2 may generate a negative output signal and/or other output signals. The positive output signal of fifth microphone 106*d*1 and the negative output signal of sixth microphone 106*d*2 may be combined to create the first secondary audio signal. The positive output signal of fifth microphone 106*d*1 and the negative output signal of sixth microphone 106*d*2 may be combined by microphone audio processing component 106*g*.

Referring to FIG. 1, in some implementations, the individual microphones of second set of microphones 106*d* may be arranged around boom body 106*b*, and/or other components. In some implementations, second set of microphones 106*d* may be arranged in a second line along a second side of boom body 106*b*. The second side of boom body 106*b* may be a side facing away from the user when headset 100 is worn by the user. The second side of boom body 106*b* may be a side facing away from user 109 when headset 100 is worn by user 109 (as illustrated in FIG. 6C).

In some implementations, boom body 106*b* may include a boom body adaptor and/or other components. In some implementations, the boom body adaptor may be coupled to set of earphones 102 and/or other components of headset 100. In some implementations, the boom body adaptor may be configured to secure boom body 106*b* to set of earphones 102 and/or other components of headset 100. In some implementations, the boom body adaptor may be configured to facilitate the transfer of information from microphone boom 106 to other components of headset 100.

In some implementations, boom body 106*b* may be coupled to set of earphones 102 and/or other components of headset 100. In some implementations, boom body 106*b* may be coupled to first earphone 102*a* and/or other components of headset 100. In some implementations, set of earphones 102 may include one or more microphone receptacles and/or other components. In some implementations, the adaptor of boom body 106*b* may be inserted into the microphone receptacle when boom body 106*b* is coupled to set of earphones 102 and/or to other components of headset 100.

Figure 8B:
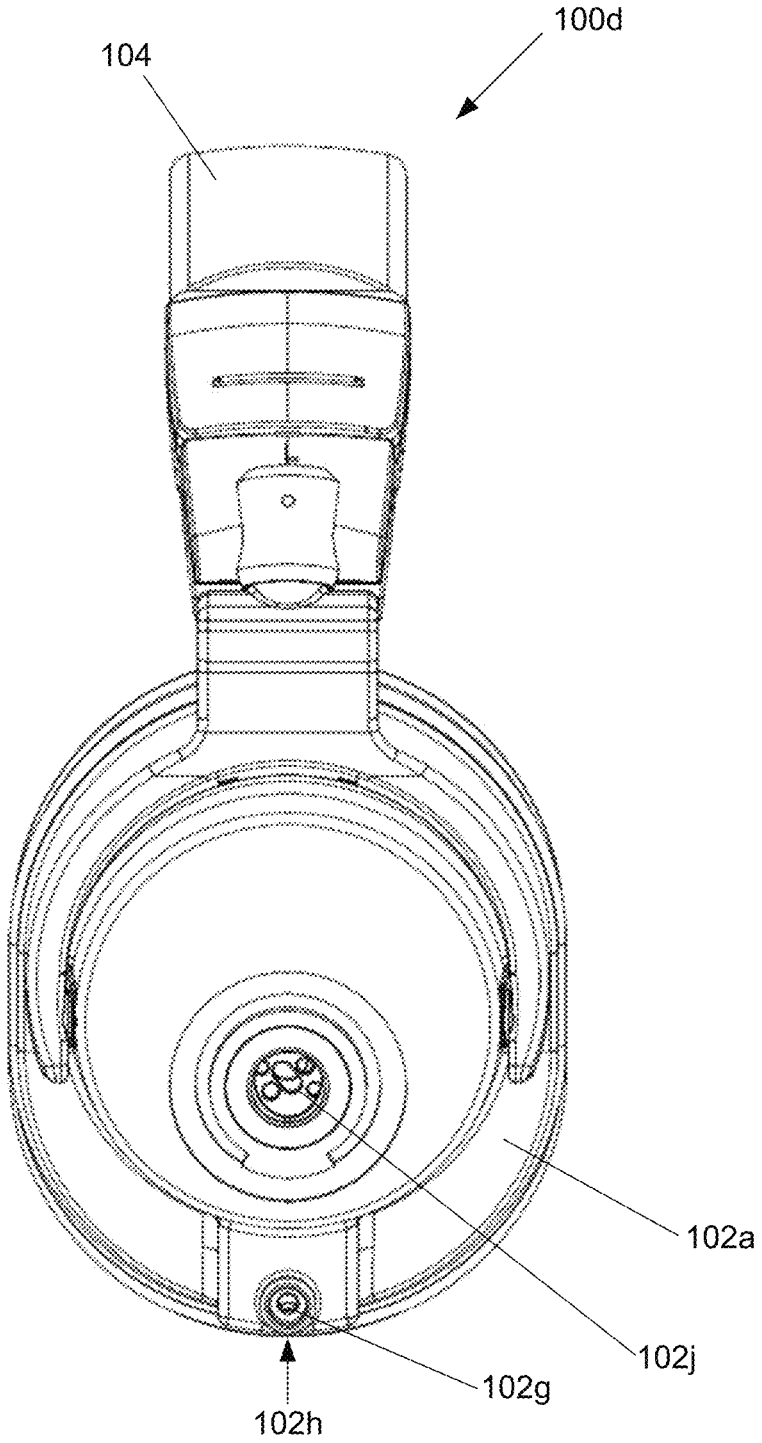
FIG. 8B illustrates a left side view of the headset without the cable and microphone boom attached.
Figure 9D:
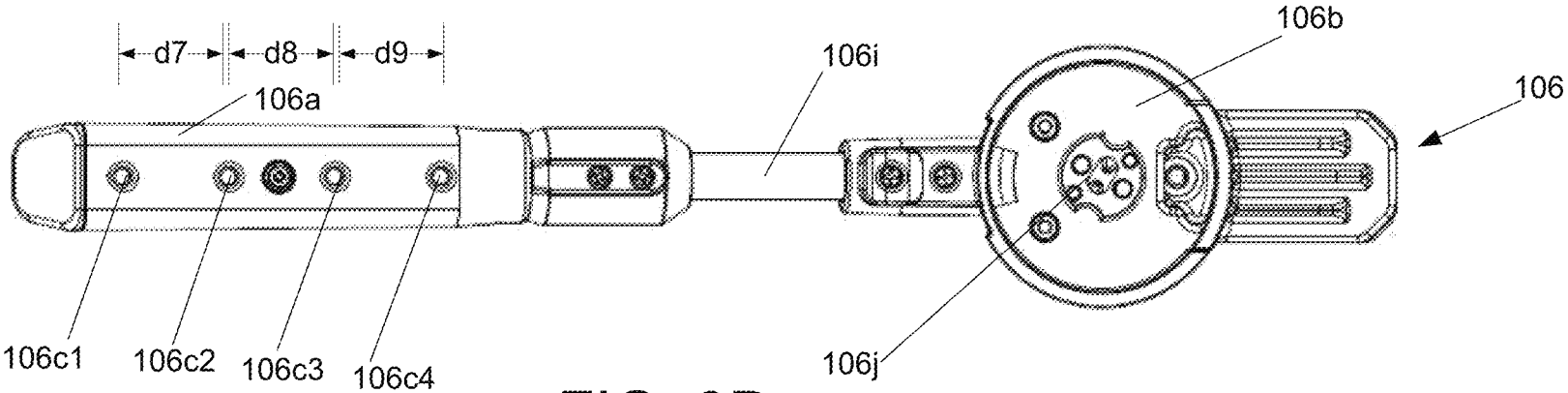
FIG. 9D illustrates a back view of the microphone boom.
Figure 9E:
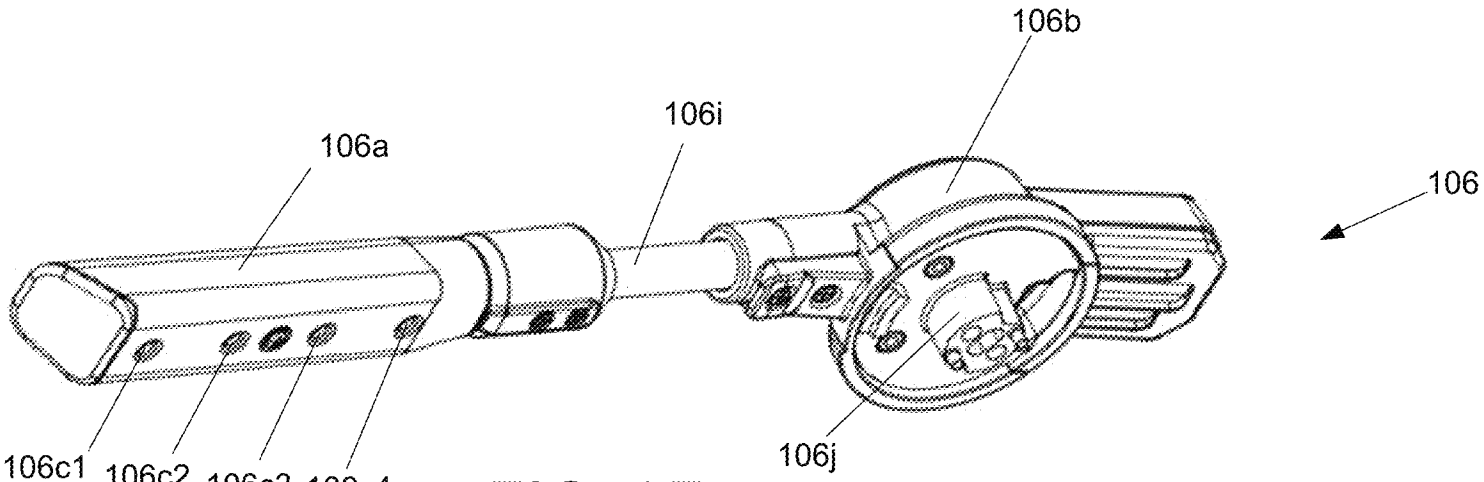
FIG. 9E illustrates a second isometric of the microphone boom.
Figure 9F:
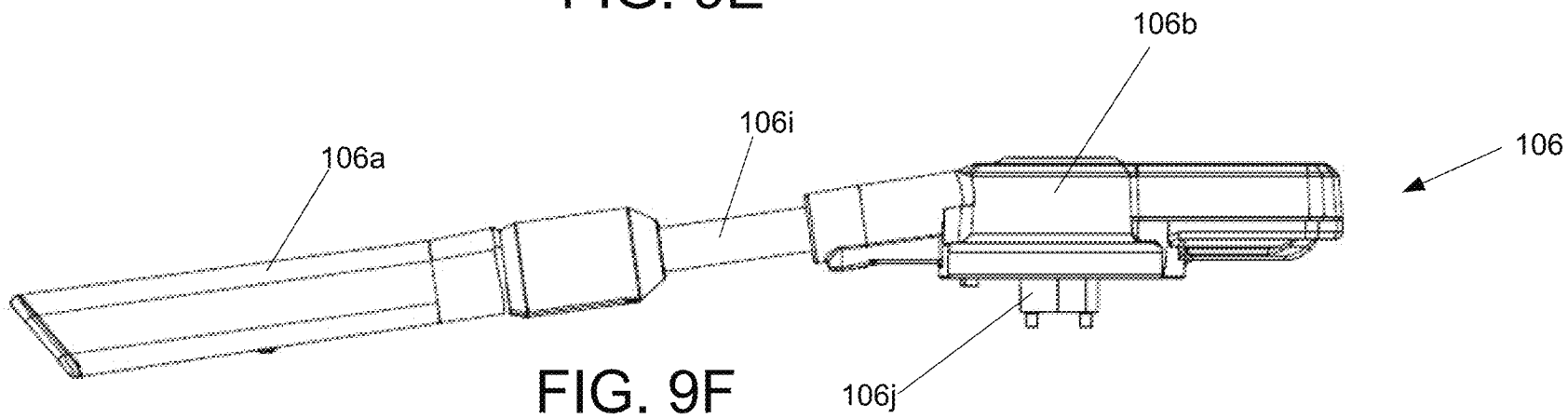
FIG. 9F illustrates a bottom view of the microphone boom.
Figure 9H:
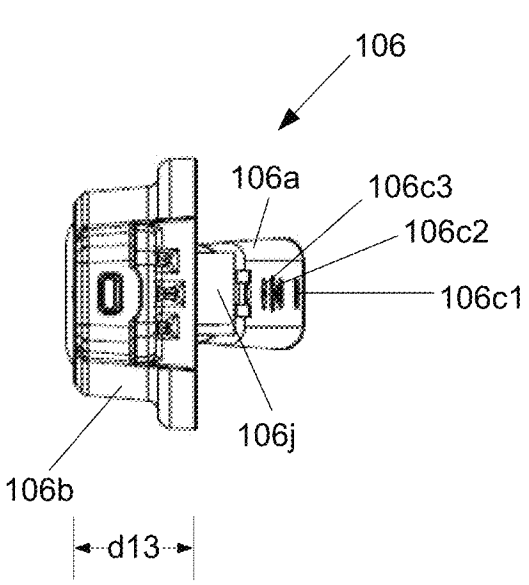
FIG. 9H illustrates a left side view of the microphone boom.
Figure 9G:
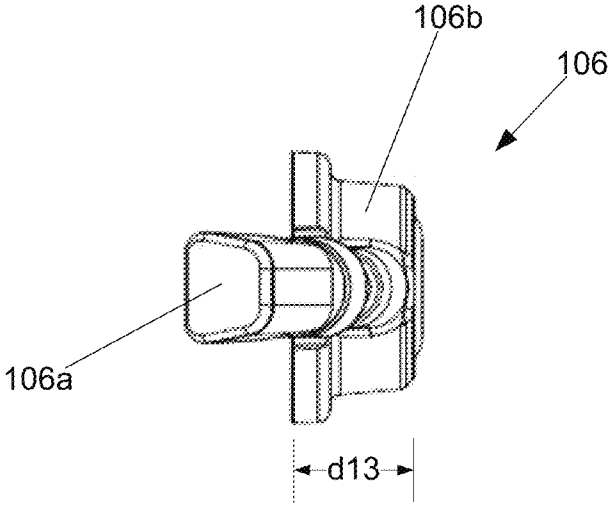
FIG. 9G illustrates a front side view of the microphone boom.
Figure 10:
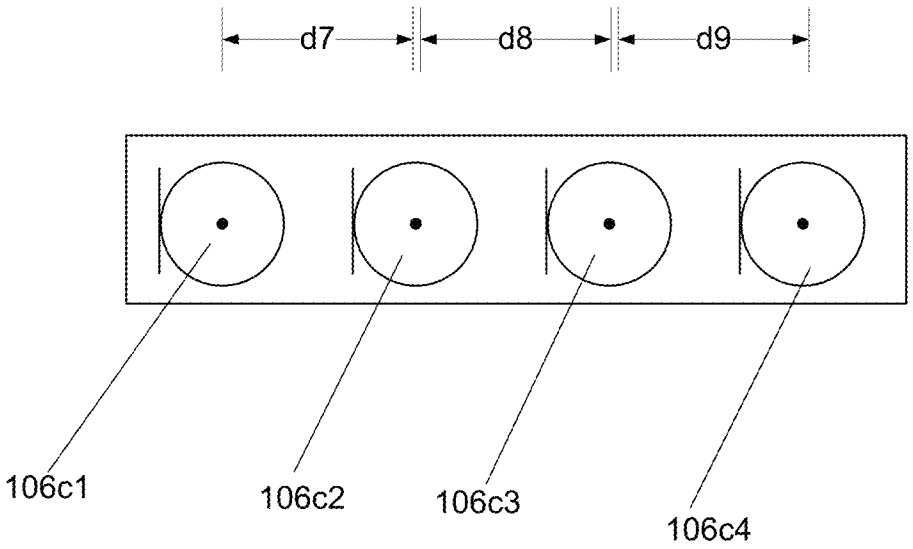
FIG. 10 illustrates a view of positions of the individual microphones of the first set of microphones.

As illustrated in FIG. 9D, in some implementations, boom body 106*b* may include a boom body adaptor 106*j* and/or other components. In some implementations, boom body adaptor 106*j* may be coupled to set of earphones 102 and/or other components of headset 100. In some implementations, boom body adaptor 106*j* may be configured to secure boom body 106*b* to set of earphones 102 and/or other components of headset 100. In some implementations, boom body adaptor 106*j* may be configured to facilitate the transfer of information from microphone boom 106 to other components of headset 100. In some implementations, boom body 106*b* may be coupled to first earphone 102*a* and/or other components of headset 100. In some implementations, adaptor 106*j* may be inserted into the microphone receptacle 102*j* (as illustrated in FIG. 8B) when boom body 106*b* is coupled to first earphone 102*a* and/or other components of headset 100.

Referring to FIG. 1, in some implementations, the microphones may include one or more micro-electrical-mechanical system (MEMS) microphones. In some implementations, the individual microphones of first set of microphones 106*c* and the individual microphones of second set of microphones 106*d* may be micro-electrical-mechanical system (MEMS) microphones. In some implementations, the MEMS microphones may include analog MEMS microphones. In some implementations, pairs of microphones having limited and/or poor directivity may be combined to operate as a gradient microphone of at least order one (and thus have improved directivity). In some implementations, a set of four microphones may be configured to operate as a gradient microphone of order two. In some implementations, a gradient microphone of order one may be combined with a gradient microphone of order two for improved directional characteristics. In some implementations, two gradient microphones of order one may be combined, e.g. by using one or both of the circuitry and the one or more microphone processor(s) 106*e*, to improve unidirectional characteristics and/or directivity.

In some implementations, one or more microphone processor(s) 106*e* may be configured by machine-readable instructions 106*f*. Executing machine-readable instructions 106*f* may cause microphone boom 106 to capture audio information. Machine-readable instructions 106*f* may include one or more computer program components. The computer program components may include one or more of a microphone audio processing component 106*g*, microphone audio generation component 106*h*, and/or other components.

In some implementations, microphone audio processing component 106*g* may be configured to obtain audio signals from one or more sets of microphones. In some implementations, microphone audio processing component 106*g* may be configured to obtain audio signals from first set of microphones 106*c*, second set of microphones 106*d*, and/or other microphones. In some implementations, the audio signals obtained from first set of microphones 106*c* may include the primary audio signals and/or other audio signals. In some implementations, the audio signals obtained from second set of microphones 106*d* may include the secondary audio signals and/or other signals. In some implementations, microphone audio processing component 106*g* may be configured to generate speaker signals. Microphone audio processing component 106*g* may generate the speaker signals from the primary audio signals and/or other information.

In some implementations, microphone audio processing component 106*g* may be configured to combine the opposite output signals of the pairs of microphones. In some implementations, microphone audio processing component 106*g* may combine the negative output signal of a first microphone and the positive output signal of a second microphone to generate a first primary audio signal. In some implementations, microphone audio processing component 106*g* may combine the positive output signal of a third microphone and the negative output signal of a fourth microphone to generate a second primary audio signal. In some implementations, microphone audio processing component 106*g* may combine the positive output signal of a fifth microphone and the negative output signal of a sixth microphone to generate a first secondary audio signal.

In some implementations, microphone audio generation component 106*h* may be configured to transmit audio signals to VOX circuit 108, and/or other components. In some implementations, microphone audio generation component 106*h* may transmit the audio signals captured by microphone boom 106 to VOX circuit 108, and/or other components. Microphone audio generation component 106*h* may transmit the primary audio signal, the secondary audio signal, and/or other audio signals to VOX circuit 108, and/or other components.

In some implementations, the individual microphone of the pairs of microphones may be positioned in proximity to one another. In some implementations, the individual microphones of the individual pairs of microphones may be spaced apart at a predetermined distance. Referring to FIG. 6C, in some implementations, the predetermined distance of the first pair of microphones may be specified by a distance d7. In some implementations, the predetermined distance of the second pair of microphones may be specified by a distance d9. In some implementations, the predetermined distance of the third pair of microphones may be specified by a distance d4 (see FIG. 9D). In some implementations, the predetermined distance of the first pair of microphones and second pair of microphones may be specified by a distance d8. Distance d8 may be measured from second microphone 106*c*2 and third microphone 106*c*3.

In some implementations, distance d7 may be range between 5 millimeters to 25 millimeters, and/or other ranges. In some implementations, distance d7 may be 5 millimeters, 10 millimeters, 15 millimeters, 20 millimeters, 25 millimeters, and/or other lengths. In some implementations, distance d8 may be range between 5 millimeters to 25 millimeters, and/or other ranges. In some implementations, distance d8 may be 5 millimeters, 10 millimeters, 15 millimeters, 20 millimeters, 25 millimeters, and/or other lengths. In some implementations, distance d9 may be range between 5 millimeters to 25 millimeters, and/or other ranges. In some implementations, distance d9 may be 5 millimeters, 10 millimeters, 15 millimeters, 20 millimeters, 25 millimeters, and/or other lengths. In some implementations, distance d7, distance d8, and distance d9 may be the same.

Referring to FIG. 1, in some implementations, the one or more sets of microphones may be configured to, when combined with electronic circuitry, provide one or more microphone patterns. In some implementations, the one or more microphone patterns may include an omnidirectional cardioid, a cardioid microphone pattern, a sub-cardioid pattern, a bi-directional cardioid pattern, a shotgun pattern, a cardioid pattern, a super-cardioid pattern, a hyper-cardioid pattern, and/or other patterns and/or a combination thereof. In some implementations, the cardioid microphone pattern may provide a high level of rejection and/or attenuation to the rear of the microphones. In some implementations, the cardioid microphone pattern may provide a high level of rejection and/or attenuation to the rear of microphone boom 106. In some implementations, the microphone patterns may be arranged such that no audio signals (or no more than an extremely weak audio signal) originating from the set of earphones may be captured.

Figure 16:
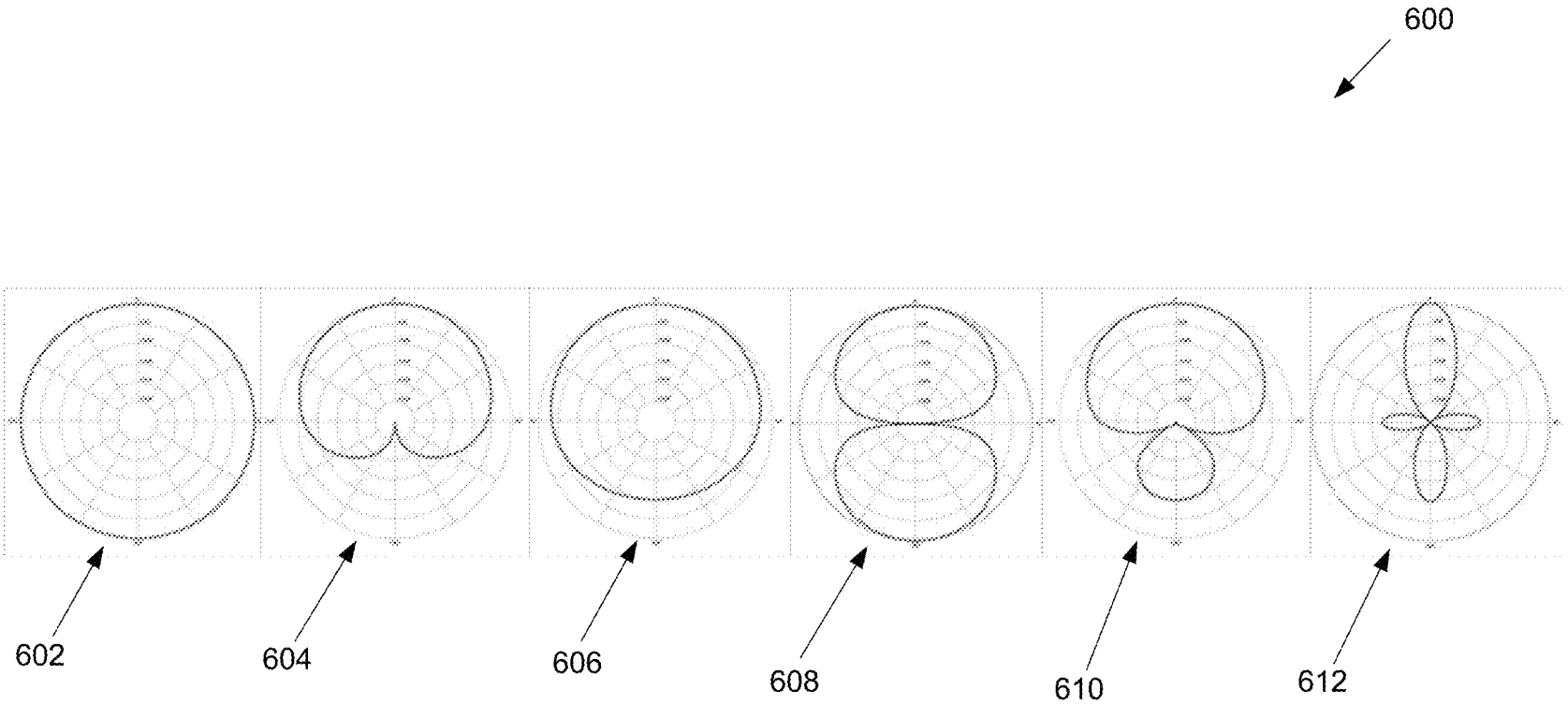
FIG. 16 illustrates a view of the MEMS microphone patterns.

As illustrated in FIG. 16, in some implementations, the one or more microphone patterns may include an omnidirectional cardioid 602, a cardioid microphone pattern 604, a sub-cardioid pattern 606, a bi-directional cardioid pattern 608, a super-cardioid pattern 610, a shotgun pattern 612, a hyper-cardioid pattern, and/or other patterns and/or a combination thereof.

Referring to FIG. 1, in some implementations, the microphones may be arranged in a beamforming array. In some implementations, the beamforming array may be configured such that audio signals at a particular angle may experience constructive interference and/or destructive interference. The beamforming array may be in one or more configurations, including a broad-side summing configuration, an endfire differential configuration, and/or other configurations and/or combinations of configurations.

In some implementations, microphone processor(s) 106*e* may be configured to provide information processing capabilities in headset 100. As such, microphone processor(s) 106*e* may include one or more of a digital processor, an analog processor, a digital circuit designed to process information, an analog circuit designed to process information, a state machine, and/or other mechanisms for electronically processing information. Although microphone processor(s) 106*e* is shown in FIG. 1 as a single entity, this is for illustrative purposes only. In some implementations, microphone processor(s) 106*e* may include a plurality of processing units. These processing units may be physically located within the same client computing device, or microphone processor(s) 106*e* may represent processing functionality of a plurality of devices operating in coordination. Microphone processor(s) 106*e* may be configured to execute computer-readable instruction components 106*g*, 106*h*, and/or other components. Microphone processor(s) 106*e* may be configured to execute components 106*g*, 106*h*, and/or other components by software; hardware; firmware; some combination of software, hardware, and/or firmware; and/or other mechanisms for configuring processing capabilities on microphone processor(s) 106*e*.

It should be appreciated that although components 106*g* and/or 106*h* are illustrated in FIG. 1 as being co-located within a single processing unit, in implementations in which microphone processor(s) 106*e* may include multiple processing units, one or more of components 106*g* and/or 106*h* may be located remotely from the other components. The description of the functionality provided by the different components 106*g* and/or 106*h* described herein is for illustrative purposes, and is not intended to be limiting, as any of components 106*g* and/or 106*h* may provide more or less functionality than is described. For example, one or more of components 106*g* and/or 106*h* may be eliminated, and some or all of its functionality may be provided by other ones of components 106*g* and/or 106*h*. As another example, microphone processor(s) 106*e* may be configured to execute one or more additional components that may perform some or all of the functionality attributed herein to one of components 106*g* and/or 106*h*.

In some implementations, VOX circuit 108 may be configured to determine when the outgoing microphone output audio signals of the sets of microphones may be transmitted. VOX circuit 108 may determine when the outgoing microphone output audio signals of the sets of microphones may be transmitted based on the audio information obtained from microphone boom 106. VOX circuit 108 may determine when the outgoing microphone output audio signals of the sets of microphones may be transmitted based on speaker information 116, ambient information 118, and/or other information or combinations thereof. VOX circuit 108 may be configured to determine whether to enable and/or disable the outgoing microphone output audio signals of the sets of microphones from being transmitted. VOX circuit 108 may determine to enable and/or disable outgoing microphone output audio signals of the sets of microphones from being transmitted based on obtained audio information, e.g., to reduce cross-talk between different signals. In some implementations, VOX circuit 108 may determine whether to enable and/or disable the outgoing microphone output audio signals of first set of microphones 106*c* from being transmitted based on speaker information 116, ambient information 118, and/or other information obtained from microphone boom 106 to reduce cross-talk between the different signals.

In some implementations, VOX circuit 108 may include one or more physical processors 108*a*, one or more electronic storage 108*g*, and/or other components. Physical processor(s) 108*a* may be configured by machine-readable instructions 108*b*. Executing machine-readable instructions 108*b* may cause VOX circuit 108 to determine when the outgoing microphone output audio signals of the sets of microphones may be transmitted. In some implementations, executing machine-readable instructions 108*b* may cause VOX circuit 108 to temporarily suppress the transmission of the outgoing microphone output audio signals. Machine-readable instructions 108*b* may include one or more computer program components. The computer program components may include one or more of an audio processing component 108*c*, an audio analysis component 108*d*, an audio suppression component 108*e*, an audio generation component 108*f*, and/or other components.

In some implementations, audio processing component 108*c* may be configured to determine one or more audio levels. Audio processing component 108*c* may determine a primary audio level based on the primary audio signal, a secondary audio level based on the secondary audio signals, and/or other audio signals.

In some implementations, audio processing component 108*c* may obtain audio signals from one or more microphones, microphone boom 106, and/or other components. Audio processing component 108*c* may obtain audio signals from microphone audio processing component 106*g*. The primary audio signal, the secondary audio signal, and/or other audio signals may be obtained from microphone audio processing component 106*g*. The primary audio signals obtained may include the first primary audio signals from the first pair of microphones, the second primary audio signals from the second pair of microphones, and/or other audio signals. The secondary audio signals obtained may include the first secondary audio signals from the third pair of microphones, and/or other audio signals.

In some implementations, audio processing component 108*c* may be configured to determine the primary audio level based on the primary audio signals and/or other information. In some implementations, the primary audio level may specify a magnitude of the primary audio signal. The primary audio level may be based on one or more of an output voltage level of the primary audio signal, an output impedance of the primary audio signal, an output power capabilities of the primary audio signal, and/or other information. In some implementations, the primary audio level may be expressed in decibels and/or other measurements.

In some implementations, the first primary audio signal, the second primary audio signal, and/or other audio signals may be different versions of speaker information 116 and/or other audio information. The first primary audio signals capture by the first pair of microphones may be different compared to the second primary audio signals captured by the second pair of microphones because the first pair of microphones and the second pair of microphones may be at different position relative to the audio source of speaker information 116 and/or other audio information. In some implementations, audio processing component 108*c* may be configured to adjust for the difference between the first primary audio signals and the second primary audio signals by delaying the first primary audio signals or the second primary audio signals by a particular time duration relative to one another.

Figure 14:
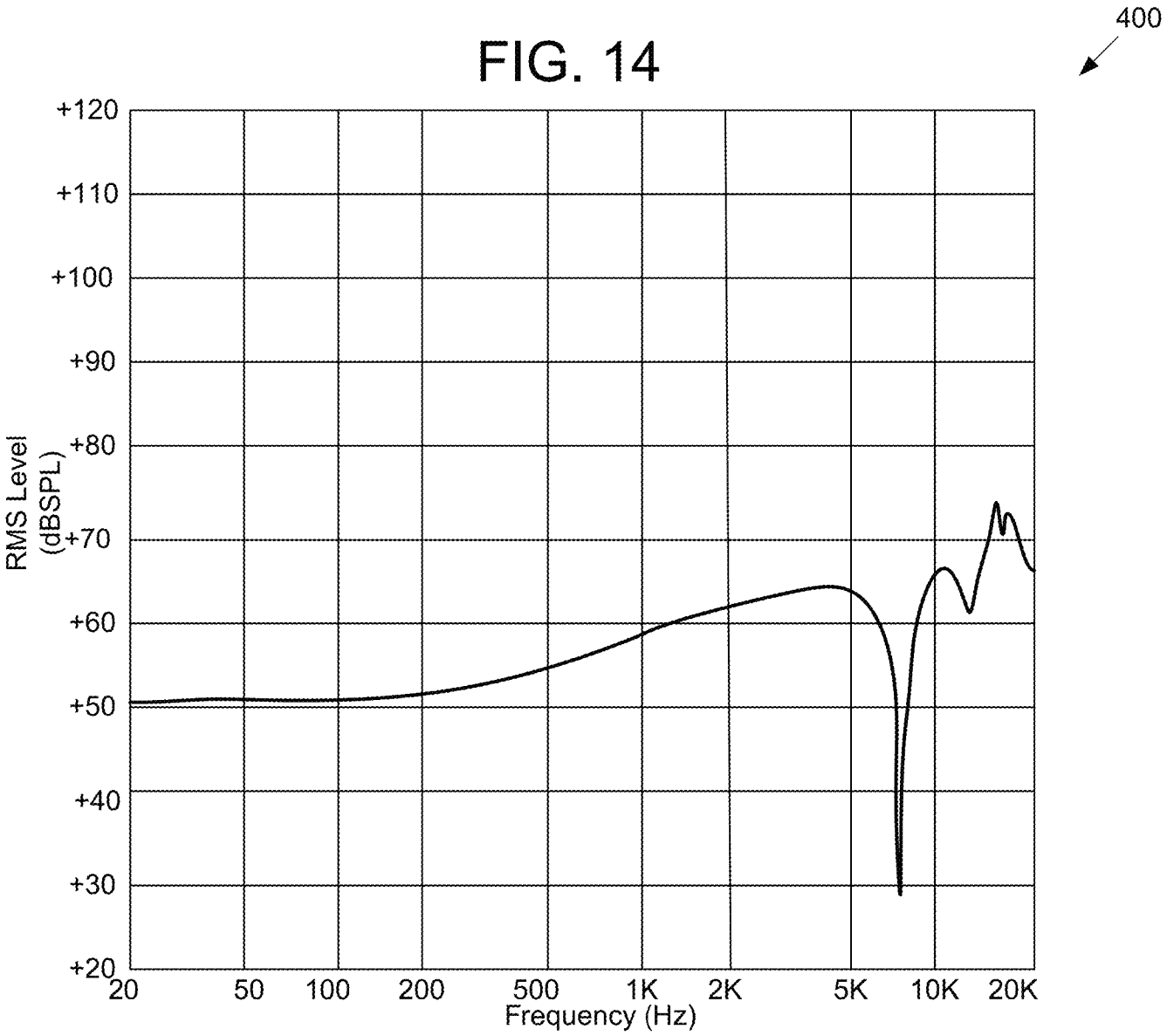
FIG. 14 illustrates a view of the VOX gate frequency response showing a response with a delay line and a Twin Tee Notch Filter.

In some implementations, audio processing component 108*c* may be configured to combine the first primary audio signal, the second primary audio signal, and/or other audio signals. The first primary audio signal, the second primary audio signal, or other audio signals may be delayed by a particular time duration by audio processing component 108*c* before being combined. In some implementations, audio processing component 108*c* may be configured to filter the combined audio signals of the first primary audio signal, the second primary audio signal, and/or other audio signals. The filter may include a twin-tee filter, and/or other filters. The twin-tee filter, and/or other filters may shape the combined audio signals with a notch around 7.5 kHz and/or other frequencies. There may be other filters used to reduce the high-end frequency response of the audio signals. In some implementations, the combined and/or filtered first primary audio signal, the second primary audio signal, and/or other audio signals may be the outgoing microphone output audio signals. By way of non-limiting example, a possible frequency response of the combined and filtered primary audio signals is illustrated in FIG. 14.

In some implementations, a delay time duration may be determined based on the distance between the individual pairs of microphones. The delay time duration may be dependent on the difference in time it takes for the audio information to travel to the first pair of microphones compared to the second pair of microphones. For example, the delay time duration may be based on the distance between the first pair of microphones and the second pair of microphones (and their relative positioning compared to the origin of the audio information), as well as the speed of sound. For example, if the first pair of microphones and the second pair of microphones are separated at a distance of about 15 millimeters, the delay time duration may be about 88 microseconds. The primary audio level may be determined based on the adjusted primary audio signal.

In some implementations, audio processing component 108*c* may be configured to determine one or more audio levels. Audio processing component 108*c* may determine a primary audio level based on the primary audio signal, a secondary audio level based on the secondary audio signals, and/or other audio signals. In some implementations, audio processing component 108*c* may be configured to determine the primary audio level based on the combined and filtered audio signals of the first primary audio and/or other information. In some implementations, audio processing component 108*c* may be configured to determine the primary audio level based on the combined and filtered first primary audio signal, the second primary audio signal, and/or other audio signals. In some implementations, the primary audio level may specify a magnitude of the primary audio signal. The primary audio level may be based on one or more of an output voltage level of the primary audio signal, an output impedance of the primary audio signal, an output power capabilities of the primary audio signal, and/or other information. In some implementations, the primary audio level may be expressed in decibels and/or other measurements.

In some implementations, audio processing component 108*c* may be configured to determine the secondary audio level based on the secondary audio signals and/or other information. In some implementations, the secondary audio level may specify a magnitude of the secondary audio signal. The secondary audio level may be based on one or more of an output voltage level of the secondary audio signal, an output impedance of the secondary audio signal, an output power capabilities of the secondary audio signal, and/or other information. In some implementations, the secondary audio level may be expressed in decibels and/or other measurements.

In some implementations, audio analysis component 108*d* may be configured to determine a minimum audio threshold level. In some implementations, audio analysis component 108*d* may determine the minimum audio threshold level based on one or more of the primary audio level, the secondary audio level, and/or other audio levels. In some implementations, audio analysis component 108*d* may determine the minimum audio threshold level based on a comparison between the primary audio level, the secondary audio level, and/or other audio levels.

In some implementations, the minimum audio threshold level may be determined based on the secondary audio level, and/or other audio levels. In some implementations, the minimum audio threshold level may be determined based on ambient information 118, and/or other information. In some implementations, the minimum audio threshold level may be an audio level equal to or greater than the secondary audio level. In some implementations, the minimum audio threshold level may be an audio level equal to or less than the secondary audio level. In some implementations, the minimum audio threshold level may change if the secondary audio level changes.

In some implementations, the minimum audio threshold level may specify a cut-off audio level for determining when the outgoing microphone output audio signals are transferred to the one or more external sources. The cut-off audio level may specify one or more of an output voltage level, an output impedance, and output power capabilities, and/or other information specify the cut-off audio level for determining when audio information is captured by the microphones. For example, the minimum audio threshold level may determine the cut-off audio level for determining when audio suppression component 108*e* enables and/or disables the outgoing microphone audio output signal of the set microphones from being transmitted.

In some implementations, audio suppression component 108*e* may be configured to determine when the outgoing microphone output audio signals of the sets of microphones may be transmitted. In some implementations, audio suppression component 108*e* may determine whether to suppress and/or disable the transmission of the outgoing microphone output audio signals of the sets of microphones. For example, such a determination may be based on comparisons between the primary audio level, minimum audio threshold, and/or other information. Audio suppression component 108*e* may facilitate the suppression (e.g., disabling) of the transmission of the outgoing microphone output audio signals. In some implementations, audio suppression component 108*e* may facilitate the resumption (e.g., enabling) of the transmission of the outgoing microphone output audio signals. The one or more comparisons may include comparisons between one or more of the minimum threshold level, the one or more audio signals levels, and/or other information.

Figure 13:
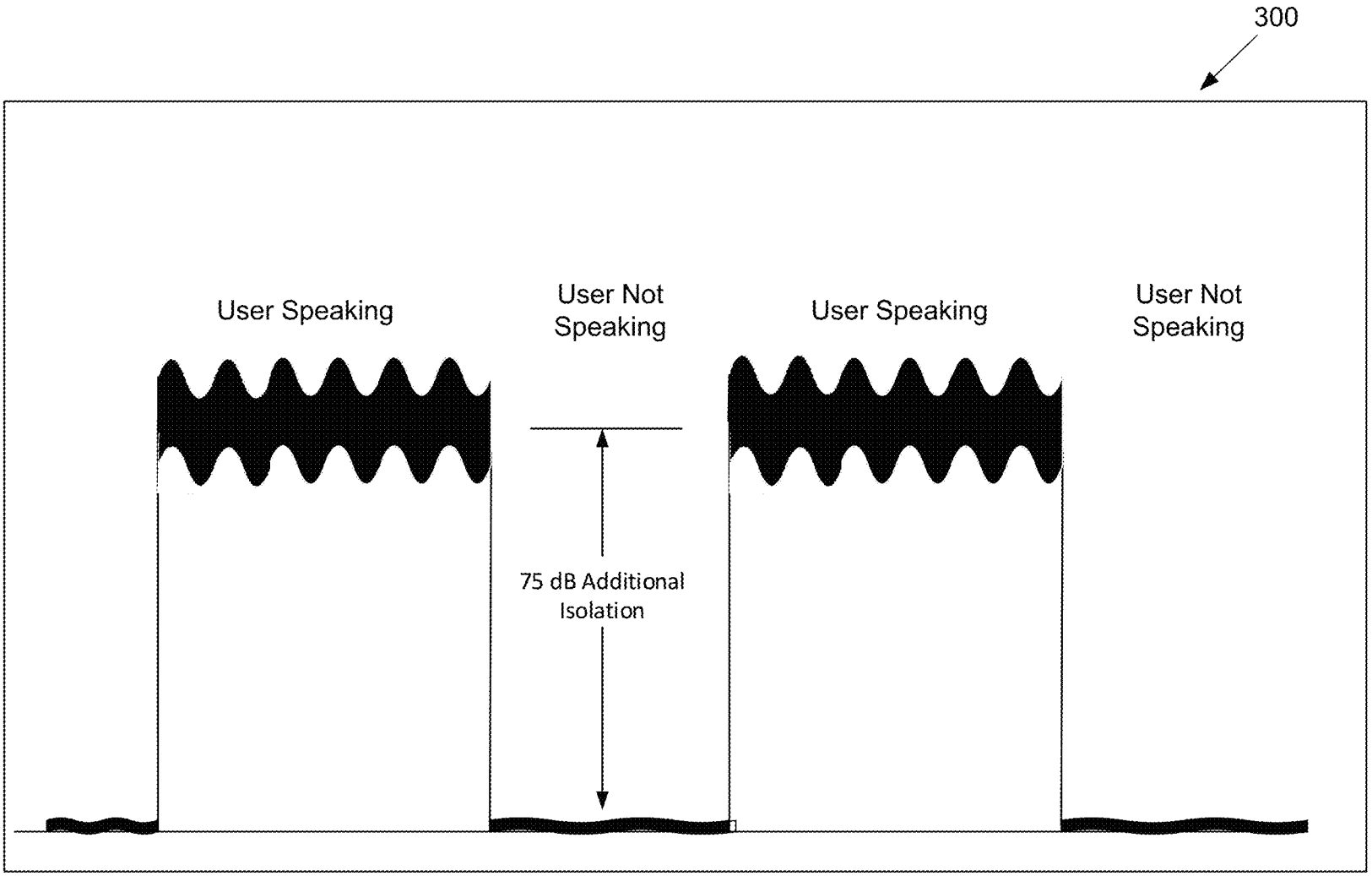
FIG. 13 illustrates a view of the VOX gate isolation.

By way of non-limiting example, responsive to the primary audio level being below the minimum threshold level, audio suppression component 108*e* may determine to suppress the transmission of the outgoing microphone output audio signals. In some implementations, responsive to the primary audio level being above the minimum threshold level, audio suppression component 108*e* may determine to resume the transmission of the outgoing microphone output audio signals. In some implementations, the additional suppression provided may be about 75 (as illustrated in FIG. 13).

In some implementations, audio generation component 108*f* may be configured to transmit audio signals to the one or more external sources. Audio generation component 108*f* may transmit the outgoing microphone output audio signals and/or other information to the one or more external sources. In some implementations, the outgoing microphone output audio signal, and/or other information may be transmitted to first external source 112 and/or other external sources. Audio generation component 108*f* may transmit the combined and filtered primary audio signals and/or other information to the one or more external sources. In some implementations, audio generation component 108*f* may transmit the outgoing microphone output audio signals to the one or more external sources through a wired connection and/or a wireless connection. In some implementations, audio generation component 108*f* may transmit the outgoing microphone output audio signals to the one or more external sources through cable(s) 110 and/or other components. In some implementations, audio generation component 108*f* may transmit the outgoing microphone output audio signals and/or other information to the one or more external sources based on audio suppression component 108*e*. In some implementations, in response to audio suppression component 108*e* determining the primary audio level being above the minimum threshold level, audio generation component 108*f* may transmit the outgoing microphone output audio signals and/or other information to the one or more external sources.

Figure 15:
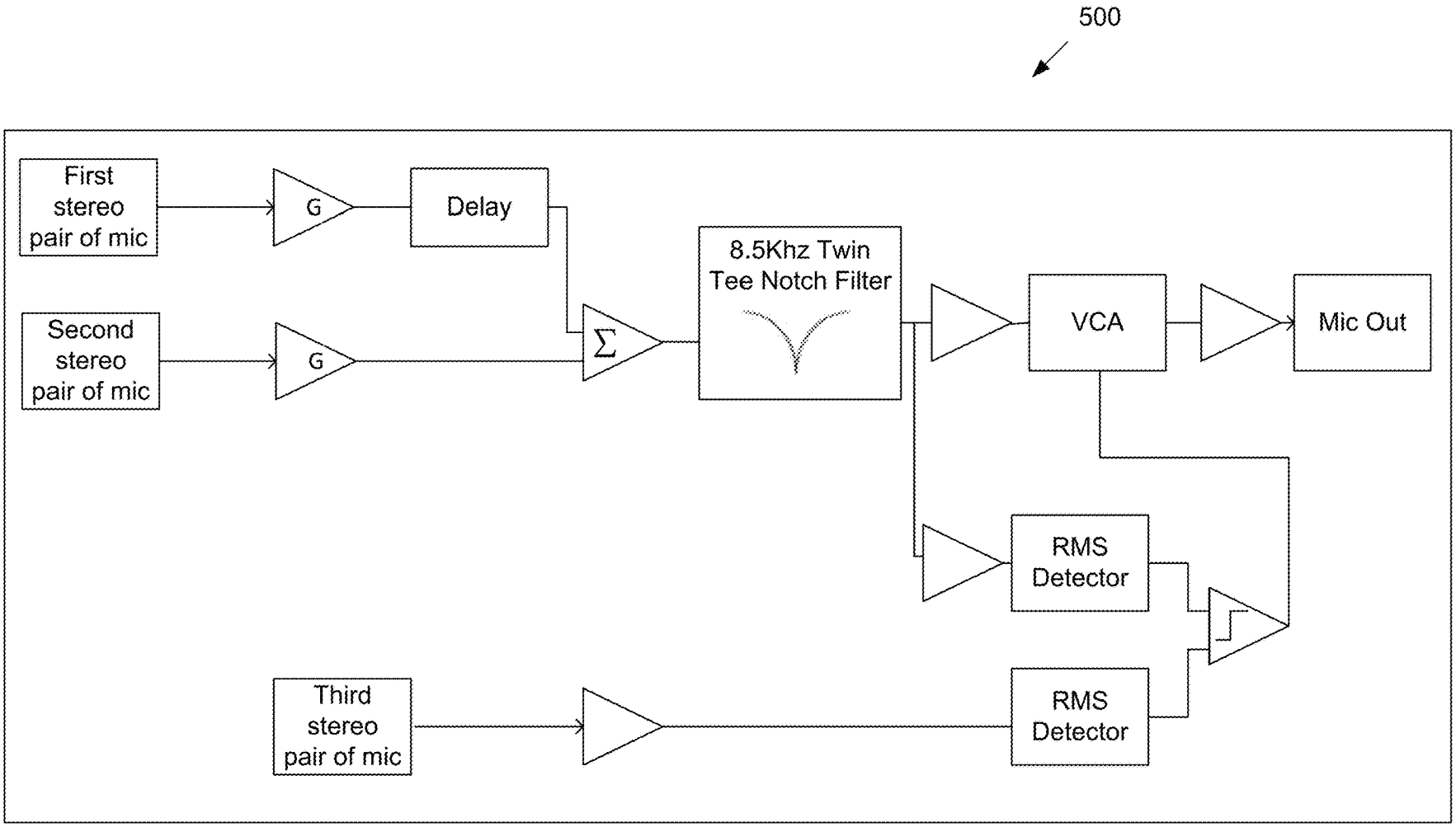
FIG. 15 illustrates a view of the block diagram of the VOX gate circuit.

As is illustrated in FIG. 15, in some implementations, VOX circuit 108 may determine whether to enable and/or disable the outgoing microphone output audio signal from being transmitted based on speaker information 116, ambient information 118, and/or other information obtained from microphone boom 106 to reduce cross-talk between the incoming earphone audio signals and the outgoing microphone output audio signals.

In some implementations, VOX circuit 108 may obtain audio signals from the first pair of microphones, the second pair of microphones, and the third pair of microphones. The audio signals from the first pair of microphones may be delayed by a particular duration and combined with the audio signals from the second pair of microphones by audio processing component 108*c*. In some implementations, the combined audio signals of the first pair of microphones and the second pair of microphones may be filtered through a twin tee notch filter by audio processing component 108*c*. A primary audio level may be determined from the filtered audio signal generated by audio processing component 108*c*. The secondary audio level may be determined from the second pair of microphones by audio processing component 108*c*. The primary audio level and the secondary audio level may be compared by audio suppression component 108*e*. Responsive to the primary audio level being above the secondary audio level, the filtered audio signals may be transferred by audio generation component 108*f*. Responsive to the primary audio level being below the secondary audio level, the filtered audio signals may not be transferred by audio generation component 108*f*.

Referring to FIG. 1, in some implementations, processor(s) 108*a* may be configured to provide information processing capabilities in headset 100. As such, processor(s) 108*a* may include one or more of a digital processor, an analog processor, a digital circuit designed to process information, an analog circuit designed to process information, a state machine, and/or other mechanisms for electronically processing information. Although processor(s) 108*a* is shown in FIG. 1 as a single entity, this is for illustrative purposes only. In some implementations, processor(s) 108*a* may include a plurality of processing units. These processing units may be physically located within the same client computing device, or processor(s) 108*a* may represent processing functionality of a plurality of devices operating in coordination. Processor(s) 108*a* may be configured to execute computer-readable instruction components 108*c*, 108*d*, 108*e*, 108*f*, and/or other components. Processor(s) 108*a* may be configured to execute components 108*c*, 108*d*, 108*e*, 108*f*, and/or other components by software; hardware; firmware; some combination of software, hardware, and/or firmware; and/or other mechanisms for configuring processing capabilities on processor(s) 108*a*.

It should be appreciated that although components 108*c*, 108*d*, 108*e*, and 108*f* are illustrated in FIG. 1 as being co-located within a single processing unit, in implementations in which processor(s) 108*a* may include multiple processing units, one or more of components 108*c*, 108*d*, 108*e*, and/or 108*f* may be located remotely from the other components. The description of the functionality provided by the different components 108*c*, 108*d*, 108*e*, and/or 108*f* described herein is for illustrative purposes, and is not intended to be limiting, as any of components 108*c*, 108*d*, 108*e*, and/or 108*f* may provide more or less functionality than is described. For example, one or more of components 108*c*, 108*d*, 108*e*, and/or 108*f* may be eliminated, and some or all of its functionality may be provided by other ones of components 108*c*, 108*d*, 108*e*, and/or 108*f*. As another example, processor(s) 108*a* may be configured to execute one or more additional components that may perform some or all of the functionality attributed herein to one of components 108*c*, 108*d*, 108*e*, and/or 108*f*.

In some implementations, cable(s) 110 may be configured to transfer and/or receive audio signals and/or other information. Cable(s) 110 may be configured to transfer and/or receive audio signals between the components of headset 100 and one or more external sources, and/or the components. In some implementations, cable(s) 110 may include one or more earphone cables 110*a*, microphone cables 110*d*, and/or other cables. In some implementations, earphone cable(s) 110*a* may include one or more first set of twisted pairs of earphone wires 110*b*, earphone connectors 110*c*, and/or other components. In some implementations, microphone cable(s) 110*d* may include one or more second set of twisted pairs of wires 110*e*, microphone connectors 110*f*, and/or other components.

In some implementations, earphone cable(s) 110*a* may be configured to carry the incoming earphone audio signals from one or more external sources and/or other sources. Earphone cable(s) 110*a* may be configured to carry the incoming earphone audio signals obtained from one or more external sources to headset 100. In some implementations, earphone cable(s) 110*a* may be configured to carry the incoming earphone audio signals from second external source 114, and/or other external sources. The incoming earphone audio signals from second external source 114 may be carried to headset 100 such that the incoming earphone audio signals may be heard by the user using components of headset 100. The incoming earphone audio signals obtained from second external source 114 may be carried to headset 100 by one or more components of earphone cable(s) 110*a*. The one or more components of earphone cable(s) 110*a* may include one or more first set of twisted pairs of earphone wires 110*b*, earphone connectors 110*c*, and/or other components. In some implementations, an earphone casing may be configured to enclose one or more components of earphone cable(s) 110*a*.

In some implementations, first set of twisted pairs of earphone wires 110*b* may provide a conductive pathway to carry the incoming earphone audio signals from the one or more external sources and/or other sources. In some implementations, first set of twisted pairs of earphone wires 110*b* may be configured to provide conductive pathways to carry the incoming earphone audio signals. First set of twisted pairs of earphone wires 110*b* may provide conductive pathways between one or more external sources and headset 100. First set of twisted pairs of earphone wires 110*b* may be configured to carry the incoming earphone audio signals from the one or more external sources and/or other sources by providing conductive pathways between the one or more external sources to headset 100. The incoming earphone audio signals may be carried from the one or more external sources to headset 100 through first set of twisted pairs of earphone wires 110*b*. The incoming earphone audio signals may be carried from second external source 114 to headset 100 through first set of twisted pairs of earphone wires 110*b*.

In some implementations, first set of twisted pairs of earphone wires 110*b* may be configured to provide set of earphones 102 with the incoming earphone audio signals from second external source 114. In some implementations, first set of twisted pairs of earphone wires 110*b* may provide a conductive pathway from second external source 114 to headset 100 such that the incoming earphone audio signals from second external source 114 may be carried to headset 100. The incoming earphone audio signals from second external source 114 may be heard by the user through set of earphones 102. First set of twisted pairs of earphone wires 110*b* may include a first twisted pair of earphone wires, a second twisted pair of earphone wire, and/or other wires. First twisted pair of earphone wires 110*b* may be configured to provide a conductive pathway from second external source 114 to headset 100 such that the incoming earphone audio signals may be carried to headset 100, and may be heard by user 109 through the first earphone and/or other earphones. The second twisted pair of earphone may be configured to provide a conductive pathway from second external source 114 to headset 100 such that the incoming earphone audio signals may be carried to headset 100 and may be heard by the user through the second earphone and/or other earphones.

In some implementations, the conductive pathways may include one or more conductive wires. In some implementations, the conductive wires may comprise of one or more conductive materials. The conductive materials may include one or more a copper, a silver, a gold, a platinum, and/or other conductive materials. In some implementations, the conductive wires may be shielded by a layer of non-conductive material.

In some implementations, individual twisted pairs of earphone wires may be shielded by one or more shielding layers. The one or more shielding layers may include one or more of a first shield layer, a second shield layer, a third shield layer, and/or other shield layers. In some implementations, the one or more shield layers may be configured to reduce mechanical coupling and/or electrical coupling between the individual twisted pairs of wires and other wires. In some implementations, the one or more shielding layers may be configured to reduce electrical, acoustical, and/or mechanical (inductive, or conductive) coupling between the wires. The one or more shielding layers may reduce cross-talk between the earphone audio signals and the microphone audio signals. The individual shields may be made of different materials. The materials may include one or more of a plastic, metal, fibers, and/or other materials. In some implementations, the one or more shield layers may be configured to increase the durability of one or more wires. In some implementations, the individual twisted pairs of earphone wires may be coupled together with the earphone casing.

In some implementations, earphone connector(s) 110*c* may facilitate one or more connections between headset 100 and one or more external sources. Earphone connector(s) 110*c* may include a first earphone connector, a second earphone connectors, and/or other earphone connectors. In some implementations, the first earphone connector may be configured to facilitate a connection between a proximal end of earphone cable(s) 110*a* and headset 100. The first earphone connector may couple the proximal end of earphone cable(s) 110*a* to headset 100. The first earphone connector may provide a conductive pathway between the proximal end of earphone cable(s) 110*a* and headset 100. In some implementations, the second earphone connector may be configured to facilitate a connection between a distal end of earphone cable(s) 110*a* and second external source 114. The second earphone connector may couple the distal end of the earphone cable(s) 110*a* to second external source 114. The second earphone connector may provide a conductive pathway between the distal end of earphone cable(s) 110*a* and second external source 114.

Figure 12:
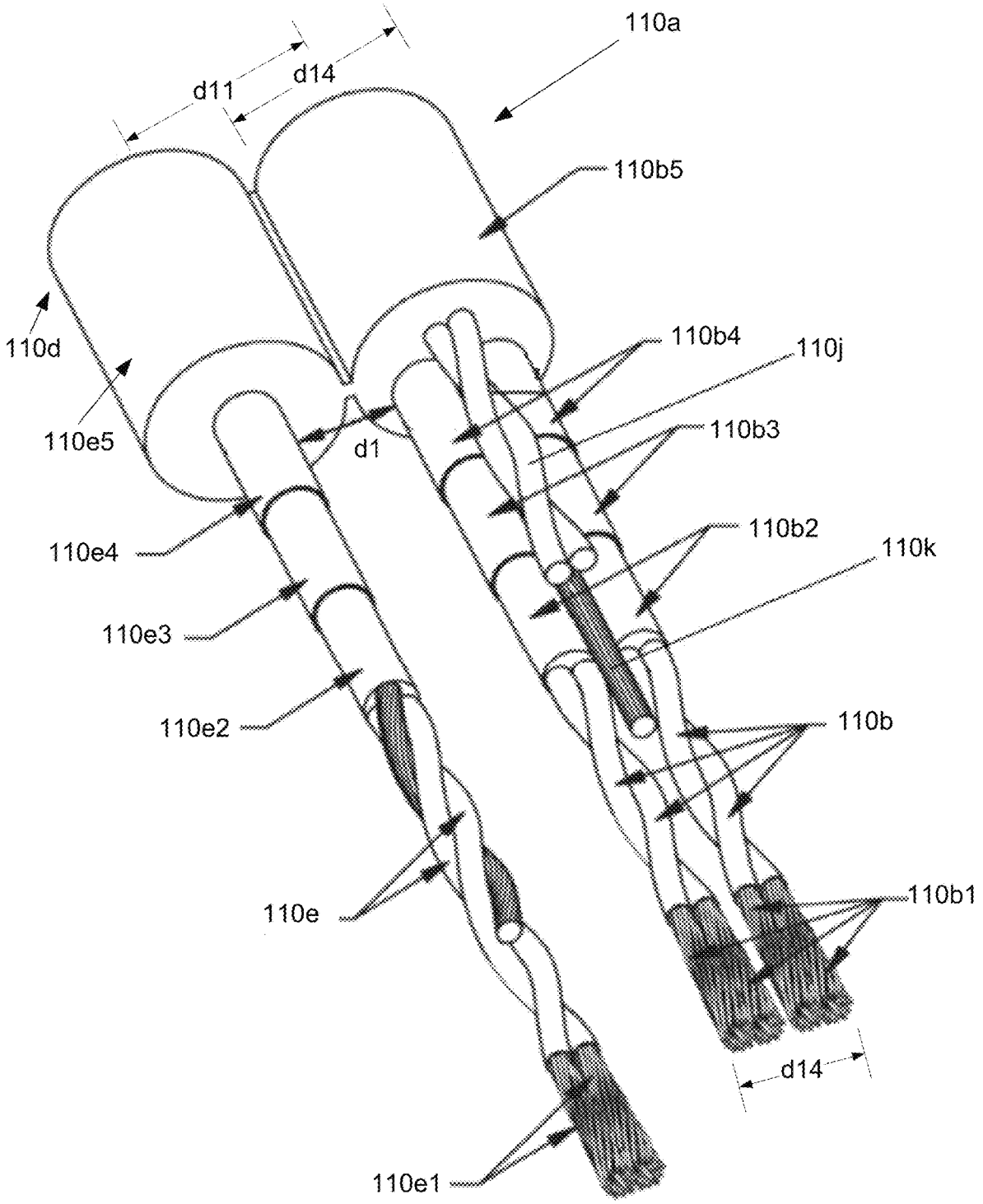
FIG. 12 illustrates a view of the cross-section of a portion of the cable.

Referring to FIG. 12, in some implementations, individual twisted pairs of earphone wires may be shielded by one or more shielding layers. The one or more shielding layers may include one or more of a first shield layer 110*b*2, a second shield layer 110*b*3, a third shield layer 110*b*4, and/or other shield layers. In some implementations, the one or more shield layers may be configured to reduce the mechanical coupling and the electrical coupling between the individual twisted pairs of wires and other wires. In some implementations, the one or more shielding layers may be configured to reduce electrical, acoustical, and/or mechanical (inductive, or conductive) coupling between the wires, and reduce cross-talk between the earphone audio signals and the microphone audio signals. The individual shield layers may be made of different materials. The materials may include one or more of a plastic, metal, fibers, and/or other materials. In some implementations, the one or more shield layers may be configured to increase the individual twisted pairs of wire's durability. In some implementations, the individual twisted pairs of earphone wires may be coupled together with an earphone casing 110*e*5.

In some implementations, the conductive pathways may include a conductive wires 110*b*1, and/or other conductive wires. In some implementations, conductive wires 110*b*1 may include conductive materials. The conductive materials may include one or more a copper, a silver, a gold, a platinum, and/or other conductive materials. In some implementations, the conductive wires 110*b*1 may be shielded by a layer of non-conductive material.

Figure 11A:
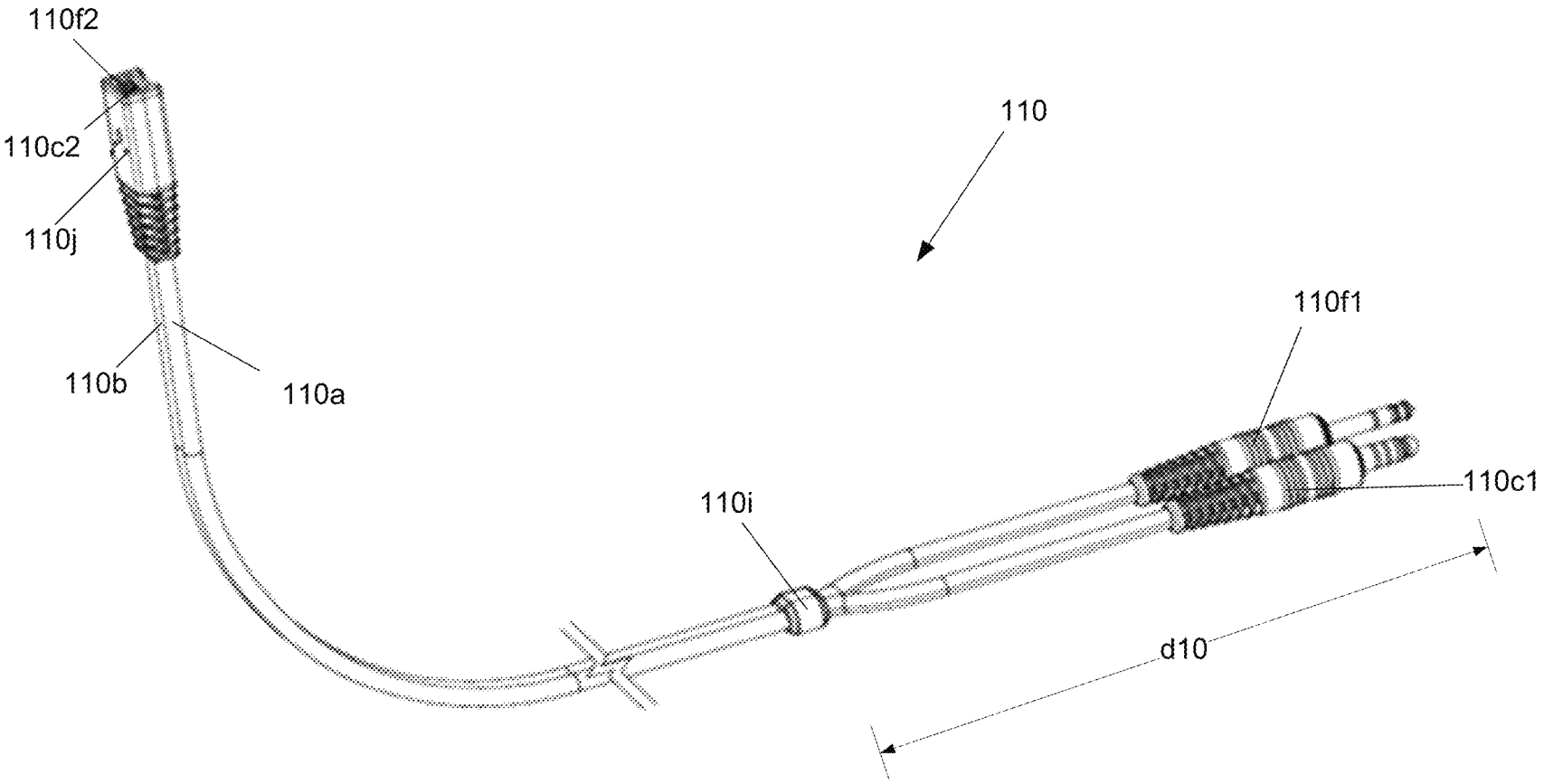
FIG. 11A illustrates a first view of the cable.
Figure 11B:
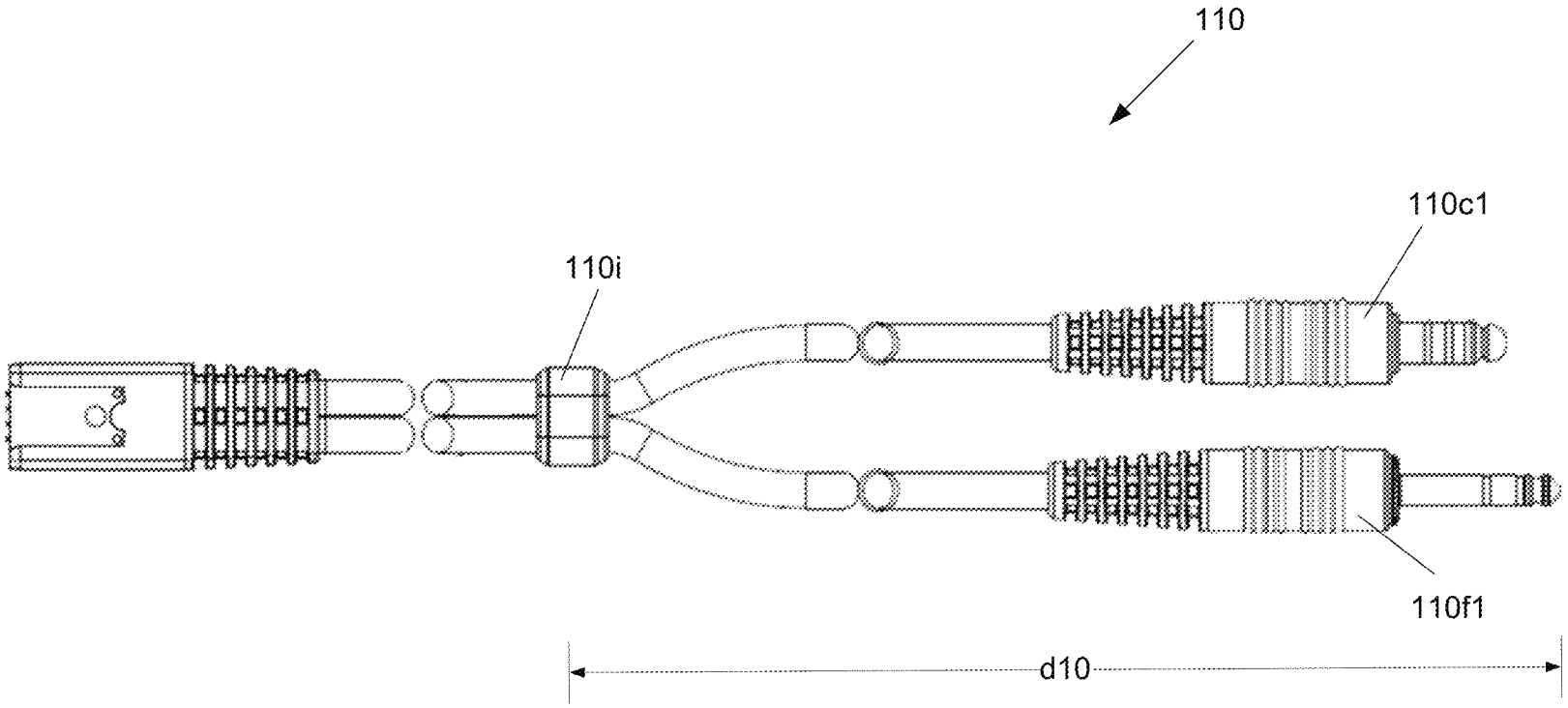
FIG. 11B illustrates a second view of the cable.

Referring to FIG. 11A, in some implementations, earphone connector(s) 110*c* may facilitate one or more connections between headset 100 and one or more external sources. Earphone connector(s) 110*c* may include a first earphone connector 110*c*2, a second earphone connectors 110*c*1, and/or other earphone connectors. In some implementations, first earphone connector 110*c*2 may be configured to facilitate a connection between a proximal end of earphone cable(s) 110*a* and headset 100. First earphone connector 110*c*2 may couple the proximal end of earphone cable(s) 110*a* to headset 100. First earphone connector 110*c*2 may provide a conductive pathway between the proximal end of earphone cable(s) 110*a* and headset 100. In some implementations, second earphone connector 110*c*1 may be configured to facilitate a connection between a distal end of earphone cable(s) 110*a* and second external source 114. Second earphone connector 110*c*1 may be couple the distal end of earphone cable(s) 110*a* to second external source 114. Second earphone connector 110*c*1 may provide a conductive pathway between the distal end of earphone cable(s) 110*a* and second external source 114.

Referring to FIG. 1, in some implementations, microphone cable(s) 110*d* may be configured to carry the outgoing microphone output audio signals from headset 100. Microphone cable(s) 110*d* may be configured to carry the outgoing microphone output audio signals obtained from headset 100 to one or more external sources. In some implementations microphone cable(s) 110*d* may be configured to carry the outgoing microphone output audio signals obtained from headset 100 to first external source 112 and/or other sources. In some implementations, microphone cable(s) 110*d* may be configured to carry the outgoing microphone output audio signals from VOX circuit 108, and/or other components.

In some implementations, the outgoing microphone output audio signals from headset 100 may be carried to first external source 114 by one or more components of microphone cable(s) 110*d*. The one or more components of microphone cable(s) 110*d* may include one or more first set of twisted pair of microphones wires 110*e*, microphone connectors 110*f*, and/or other components. In some implementations, a microphone casing may be configured to enclose one or more components of microphone cable(s) 110*c*.

In some implementations, first set of twisted pairs of microphone wire(s) 110*e* may provide a conductive pathway to carry the outgoing microphone output audio signals from headset 100. The outgoing microphone output audio signals may be captured by microphone boom 106 and/or other components of headset 100. In some implementations, first set of twisted pairs of microphone wire(s) 110*e* may be configured to provide conductive pathways for the outgoing microphone output audio signals. The outgoing microphone output audio signals may be carried from headset 100 to the one or more external sources through the first set of twisted pairs of microphone wire(s) 110*e*. First set of twisted pairs of microphone wire(s) 110*e* may be configured to carry the outgoing microphone output audio signals from headset 100 to the one or more external sources by providing conductive pathways between headset 100 and the one or more external sources. The outgoing microphone output audio signals may be carried from headset 100 to first external source 112 through first set of twisted pairs of microphone wire(s) 110*e*. In some implementations, first set of twisted pairs of microphone wire(s) 110*e* may include a first twisted pair of microphone wires, and/or other wires. The first twisted pair of microphone wires may be configured to provide a conductive pathway from VOX circuit 108 to first external source 112. In some implementations, individual twisted pairs of microphone wires may be shielded by one or more shielding layers. The one or more shield layers may include one or more of a fourth shield layer, a fifth shield layer, a sixth shield layer 110*e*4, and/or other shield layers. In some implementations, the one or more shields layers may be configured to reduce the mechanical coupling and the electrical coupling between the individual twisted pairs of wires and other wires. In some implementations, the one or more shielding layers may be configured to reduce electrical, acoustical, and/or mechanical (inductive, or conductive) coupling between the wires, and reduce cross-talk between the earphone audio signals and the microphone audio signals. The individual shield layers may be made of different materials. The materials may include one or more of a plastic, metal, fibers, and/or other materials. In some implementations, the one or more shield layers may be configured to increase the individual twisted pairs of wire's durability. In some implementations, the individual twisted pairs of earphone wires may be coupled together with a microphone casing.

In some implementations, microphone connectors 110*f* may facilitate one or more connections between headset 100 and one or more external sources. Microphone connectors 110*f* may include a first microphone connector, a second microphone connectors, and/or other microphone connectors. In some implementations, the first microphone connector may be configured to facilitate a connection between a proximal end of microphone cable(s) 110*d* and headset 100. The first microphone connector may couple the proximal end of microphone cable(s) 110*d* to headset 100. The first microphone connector may provide a conductive pathway between the proximal end of microphone cable(s) 110*d* and headset 100. In some implementations, the second microphone connector may be configured to facilitate a connection between a distal end of microphone cable(s) 110*d* and first external source 112. The second microphone connector may couple the distal end of microphone cable(s) 110*d* to first external source 112. The second microphone connector may provide a conductive pathway between the distal end of microphone cable(s) 110*d* and first external source 112.

In some implementations, the second earphone connectors and the second microphone connector may be coupled together by a connector adaptor. The connector adaptor may be configured to be coupled to headset 100. In some implementations, the connector adaptor may be coupled to the first earphone, and/or other components of headset 100. The connector adaptor may be coupled to headset 100 such that audio signals may be carried from headset 100 to the one or more external sources. The connector adaptor may be coupled to headset 100 such that audio signals may be carried from the one or more external sources to headset 100.

Referring to FIG. 12, in some implementations, individual twisted pairs of microphone wires may be shielded by one or more shielding layers. The one or more shield layers may include one or more of a fourth shield layer 110*e*2, a fifth shield layer 110*e*3, a sixth shield layer 110*e*4, and/or other shield layers. In some implementations, the one or more shields layers may be configured to reduce the mechanical coupling and the electrical coupling between the individual twisted pairs of wires and other wires. In some implementations, the one or more shielding layers may be configured to reduce electrical, acoustical, and/or mechanical (inductive, or conductive) coupling between the wires, and reduce cross-talk between the earphone audio signals and the microphone audio signals. The individual shield layers may be made of different materials. The materials may include one or more of a plastic, metal, fibers, and/or other materials. In some implementations, the one or more shield layers may be configured to increase the individual twisted pairs of wire's durability. In some implementations, the individual twisted pairs of earphone wires may be coupled together with a microphone casing 110*e*5.

In some implementations, the conductive pathways may include a conductive wires 110*e*1, and/or other conductive wires. In some implementations, conductive wires 110*e*1 may include conductive materials. In some implementations, conductive wires 110*e*1 may be shielded by a layer of non-conductive material.

Referring to FIG. 11A, in some implementations, microphone connectors 110*f* may facilitate one or more connections between headset 100 and one or more external sources via first set of twisted pairs of microphone wire(s) 110*e*. Microphone connectors 110*f* may include a first microphone connector 110*f*2, a second microphone connectors 110*f*1, and/or other microphone connectors. In some implementations, first microphone connector 110*f*2 may be configured to facilitate a connection between a proximal end of microphone cable(s) 110*d* and headset 100. First microphone connector 110*f*2 may couple the proximal end of microphone cable(s) 110*d* to headset 100. First microphone connector 110*f*2 may provide a conductive pathway between the proximal end of microphone cable(s) 110*d* and headset 100. In some implementations, second microphone connector 110*f*1 may be configured to facilitate a connection between a distal end of microphone cable(s) 110*d* and first external source 112. Second microphone connector 110*f*1 may couple the distal end of microphone cable(s) 110*d* to first external source 112. Second microphone connector 110*f*1 may provide a conductive pathway between the distal end of microphone cable(s) 110*d* and first external source 112.

Referring to FIG. 12, in some implementations, first set of twisted pairs of earphone wires 110*b* and first set of twisted pairs of microphone wire(s) 110*e* may be separated by distance d1, and/or other distances. First set of twisted pairs of earphone wires 110*b* and first set of twisted pairs of microphone wire(s) 110*e* may be separated by distance d1, and/or other distances to reduce electrical, acoustical, and/or mechanical (inductive, or conductive) coupling between the wires, and reduce cross-talk between the earphone audio signals and the microphone audio signals. In some implementations, distance d1 may range between 1 mm to 10 mm, and/or other distances. In some implementations, distance d1 may range between 2 mm to 8 mm, and/or other distances. In some implementations, distance d1 may range between 2.5 mm to 6 mm, and/or other distances.

Figure 7B:
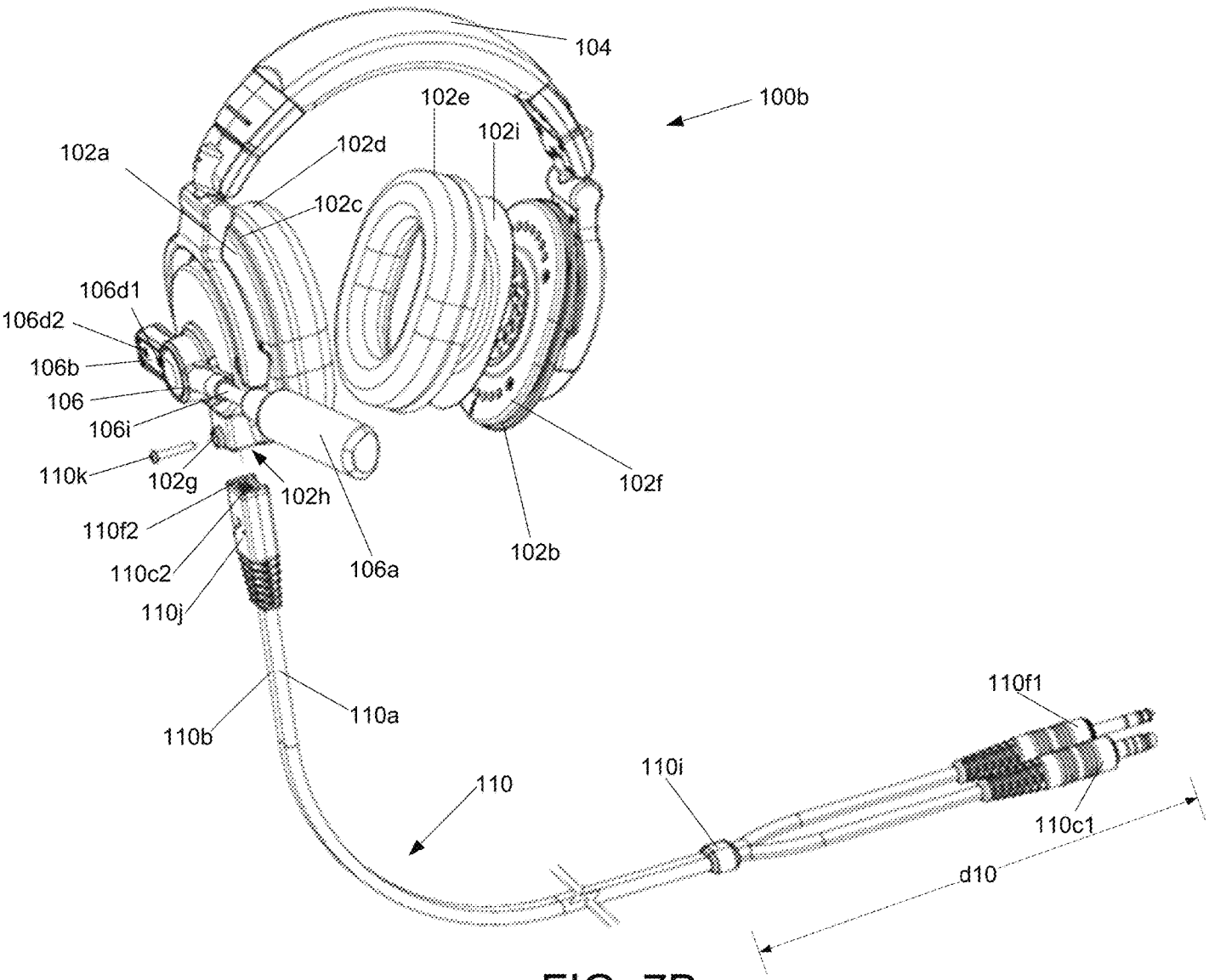
FIG. 7B illustrates an isometric view of the headset with the cable unattached.

Referring to FIG. 11A, in some implementations, second earphone connectors 110*fc*1 and second microphone connector 110*f*1 may be coupled by a connector adaptor 110*j*. In some implementations, connector adaptor 110*j* may include second earphone connectors 110*fc*1, second microphone connector 110*f*1, and/or other connectors. For example, connector adaptor 110*j* may be a USB adaptor and/or other adaptors that includes second earphone connectors 110*fc*1, second microphone connector 110*f*1, and/or other connectors. Connector adaptor 110*j* may be configured to be coupled to headset 100. In some implementations, connector adaptor 110*j* may be coupled to first earphone 102*a* (illustrated in FIG. 7A), and/or other components of headset 100. In some implementations, connector adaptor 110*j* may be uncoupled to first earphone 102*a* (illustrated in FIG. 7B), and/or other components of headset 100. In some implementations, connector adaptor 110*j* may be coupled to first earphone 102*a* at cable coupling receptacle 102*h* (illustrated in FIG. 8A). Connector adaptor 110*j* may be coupled to headset 100 such that audio signals may be carried from headset 100 to the one or more external sources. The connector adaptor may be coupled to headset 100 such that audio signals may be carried from the one or more external sources to headset 100.

Referring to FIG. 1, in some implementations, portions of earphone cables 110*a* and microphone cable(s) 110*d* may be coupled and/or bound together. In some implementations, earphone cables 110*a* and microphone cable(s) 110*d* may be coupled and/or bound together and set apart from one another by a predetermined distance. Earphone cables 110*a* and microphone cable(s) 110*d* may be set apart from one another by the predetermined distance to reduce electrical, acoustical, and mechanical coupling between earphone cables 110*a* and microphone cable(s) 110*d*. In some implementations, earphone cables 110*a* and microphone cable(s) 110*d* may be coupled by the earphone casing and the microphone casing. In some implementations, the distal end of earphone cables 110*a* and microphone cable(s) 110*d* may not be coupled.

Referring to FIG. 12, in some implementations, portions of earphone cables 110*a* and microphone cable(s) 110*d* may be coupled and/or bound together. Earphone cables 110*a* and microphone cable(s) 110*d* may be coupled by earphone casing 110*b*5 and microphone casing 110*e*5. Earphone cables 110*a* and microphone cable(s) 110*d* may be separated by a predetermined distance d11. In some implementations, distance d11 may range between 1 mm to 10 mm, and/or other distances. In some implementations, distance d11 may range between 3 mm to 9 mm, and/or other distances. In some implementations, distance d11 may range between 5 mm to 8 mm, and/or other distances. In some implementations, the earphone cables and the microphone cable(s) may be separated for the entire length of at least one of the cables. In some implementations, the earphone cables and the microphone cable(s) may be separated for at least 1, 2, 3, 4, 5, 6, or more feet along the length of these cables.

Referring to FIG. 11A, in some implementations, portions of earphone cables 110*a* and microphone cable(s) 110*d* may not be coupled. Portions of the distal end of earphone cables 110*a* and microphone cable(s) 110*d* may not be coupled. A separator 110*i* may separate the portions of earphone cables 110*a* and microphone cable(s) 110*d* coupled from the portions of earphone cables 110*a* and microphone cable(s) 110*d* not coupled. Separator 110*i* may be configured to prevent the proximal end of earphone cables 110*a* and microphone cable(s) 110*d* from being uncoupled. In some implementations, the distal end of earphone cables 110*a* and microphone cable(s) 110*d* may by length d10, and/or other lengths. In some implementations, length d10 may range between 200 mm to 300 mm, and/or other lengths. In some implementations, length d10 may range between 230 mm to 280 mm, and/or other lengths. In some implementations, length d10 may range between 240 mm to 270 mm, and/or other lengths.

Figure 17:
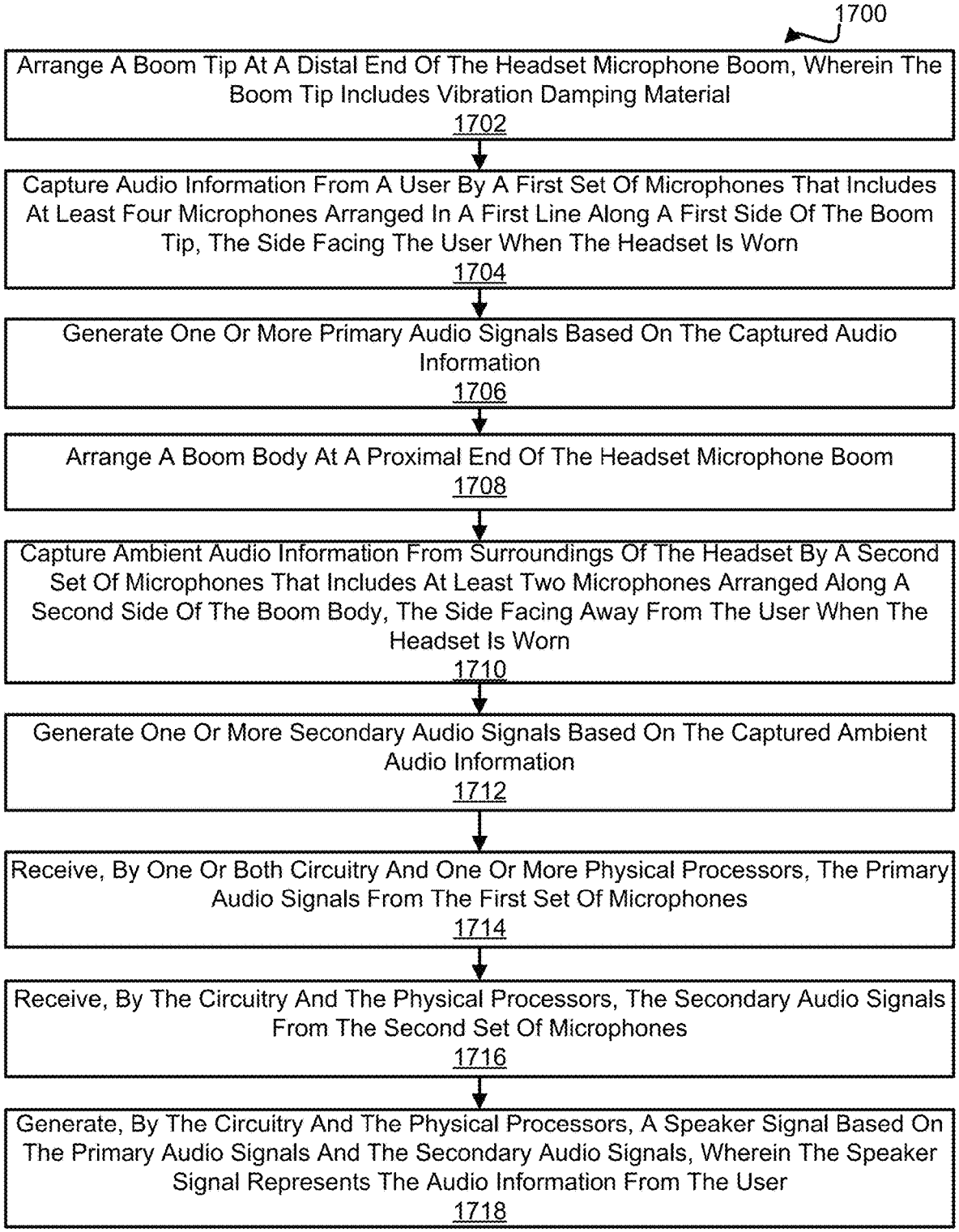
FIG. 17 illustrates the method for the capturing audio information using the microphone boom, in accordance with one or more embodiments.

FIG. 17 illustrates a method 1700 for reducing cross-talk in between audio signals and/or other information transferred and received from a headset. The operations of method 1700 presented below are intended to be illustrative. In some implementations, method 1700 may be accomplished with one or more additional operations not described, and/or without one or more of the operations discussed. Additionally, the order in which the operations of method 1700 are illustrated in 17 FIG. 17 and described below is not intended to be limiting.

In some implementations, the headset of method 1700 may include one or more a set of earphones, a headset frame, a microphone boom, a VOX circuit (e.g. a microphone gating circuitry/circuit), cable(s), and/or other components for reducing cross-talk.

At an operation 1702, the boom tip is arranged at a distal end of the headset microphone boom. The boom tip may include vibration damping material. In some embodiments, operation 1702 is performed by a microphone boom the same as or similar to microphone boom 106 (shown in FIG. 1 and described herein).

At an operation 1704, audio information from a user is captured by a first set of microphones. The first set of microphones is located in the boom tip. The first set of microphones may include at least four microphones arranged in a first line along a first side of the boom tip, the first side of the boom tip being a side of the boom tip facing the user when the headset is worn by the user. In some embodiments, operation 1704 is performed by the microphone boom the same as or similar to microphone boom 106 (shown in FIG. 1 and described herein).

At an operation 1706, one or more primary audio signals are generated based on the captured audio information. In some embodiments, operation 1706 is performed by the microphone boom the same as or similar to microphone boom 106 (shown in FIG. 1 and described herein).

At an operation 1708, the boom body is arranged at a proximal end of the headset microphone boom. In some embodiments, operation 1708 is performed by the microphone boom the same as or similar to microphone boom 106 (shown in FIG. 1 and described herein).

At an operation 1710, ambient audio information from surroundings of the headset is captured by a second set of microphones. The second set of microphones is located in the boom body. The second set of microphones may include at least two microphones arranged along a second side of the boom body, the second side of the boom body being a side facing away from the user when the headset is worn by the user. In some embodiments, operation 1710 is performed by the microphone boom the same as or similar to microphone boom 106 (shown in FIG. 1 and described herein).

At an operation 1712, one or more secondary audio signals are generated based on the captured ambient audio information. In some embodiments, operation 1712 is performed by the microphone boom the same as or similar to microphone boom 106 (shown in FIG. 1 and described herein).

At an operation 1714, the one or more primary audio signals from the first set of microphones are received by one or both of the circuitry and the one or more physical processors. In some embodiments, operation 1714 is performed by a VOX circuit the same as or similar to VOX circuit 108 (shown in FIG. 1 and described herein).

At an operation 1716, the one or more secondary audio signals from the second set of microphones are received by one or both of the circuitry and the one or more physical processors. In some embodiments, operation 1716 is performed by the VOX circuit the same as or similar to VOX circuit 108 (shown in FIG. 1 and described herein).

At an operation 1718, a speaker signal based on the one or more primary audio signals and the one or more secondary audio signals are generated by one or both of the circuitry and the one or more physical processors. The speaker signal represents the audio information from the user. In some embodiments, operation 1718 is performed by the VOX circuit the same as or similar to VOX circuit 108 (shown in FIG. 1 and described herein).

Figure 18:
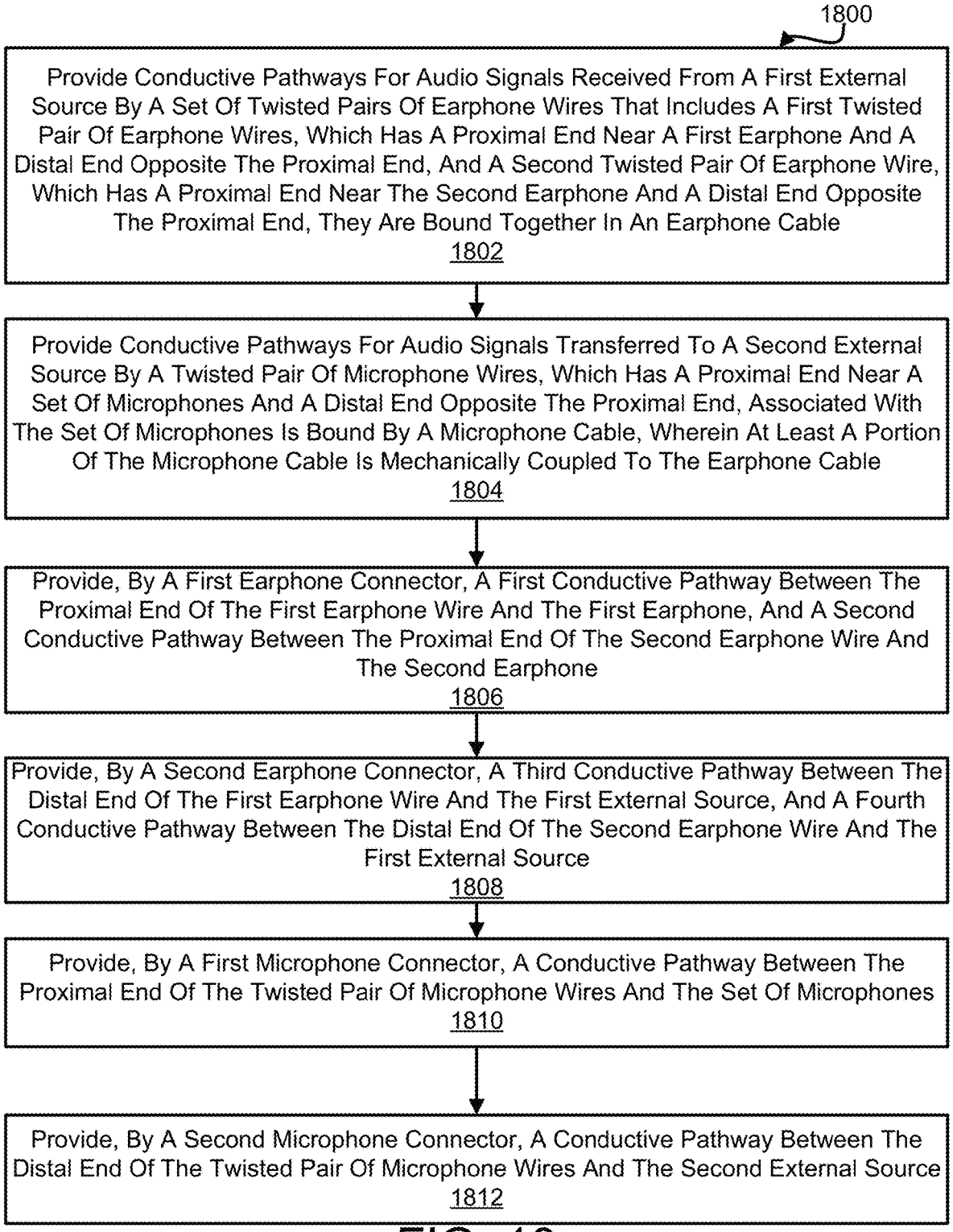
FIG. 18 illustrates the method for the transferring and receiving audio signals between a set of earphones, a set of microphones, and one or more physical processors, in accordance with one or more embodiments.

FIG. 18 illustrates a method 1800 for providing conductive pathways for transfer and/or receive audio signals and/or other information. The operations of method 1800 presented below are intended to be illustrative. In some implementations, method 1800 may be accomplished with one or more additional operations not described, and/or without one or more of the operations discussed. Additionally, the order in which the operations of method 1800 are illustrated in FIG. 18 and described below is not intended to be limiting.

In some implementations, the method 1800 may include transferring and/or receiving audio signals and/or other information by cable(s). The cable(s) may be configured to transfer and/or receive audio signals between the components of the headset and the one or more external sources, and/or the components. In some implementations, the cable(s) may include one or more earphone cables, microphone cables, and/or other cables. The earphone cable(s) may be configured to carry incoming earphone audio signals from the one or more external sources and/or other sources. The earphone cable(s) may be configured to carry the incoming earphone audio signals obtained from the one or more external sources to the headset. The microphone cable(s) may be configured to carry outgoing microphone output audio signals to the one or more external sources and/or other sources. The earphone cable(s) may be configured to carry the outgoing microphone output audio signals obtained the headset to the one or more external sources.

Figure 4:
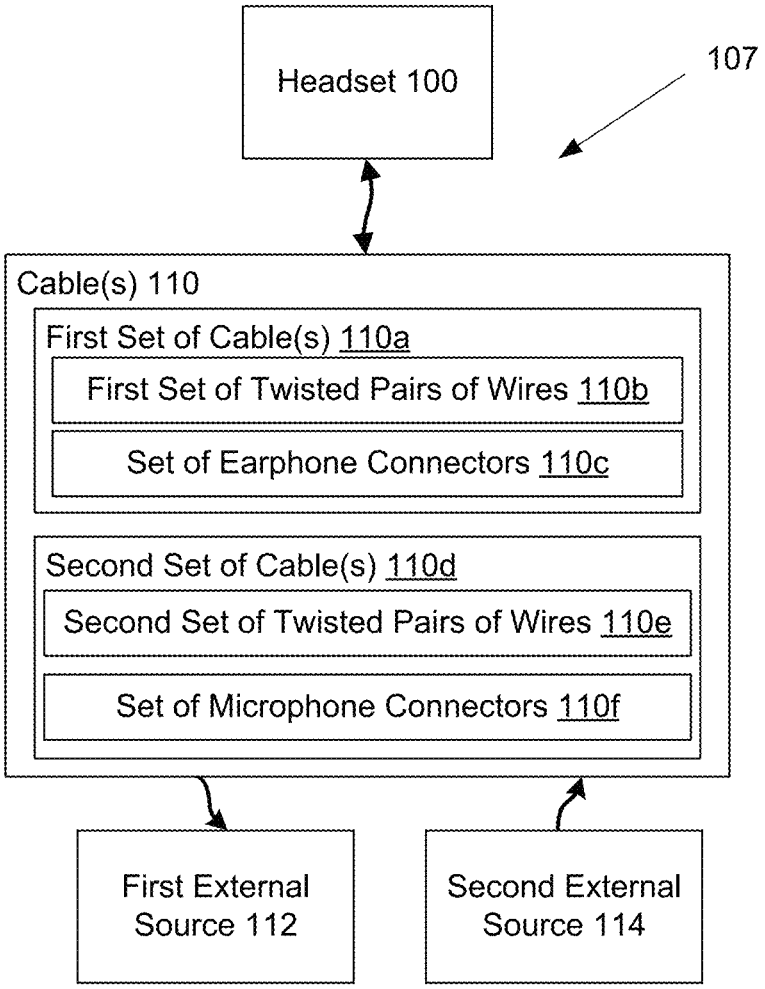
FIG. 4 illustrates the cable system of the headset, in accordance with one or more embodiments.

At an operation 1802, conductive pathways are provided for audio signals received from a first external source by a set of twisted pairs of earphone wires. The set of twisted pairs of earphone wires may include a first twisted pair of earphone wires associated with a first earphone and a second twisted pair of earphone wire associated with a second earphone. The first twisted pair of earphone wires and the second twisted pair of earphone wires are bound together in an earphone cable. The first twisted pair of earphone wires has a proximal end near the first earphone and a distal end opposite the proximal end. The second twisted pair of earphone wires has a proximal end near the second earphone and a distal end opposite the proximal end. In some embodiments, operation 1802 is performed by a first set of cables the same as or similar to first set of cable(s) 110*a* (shown in FIG. 4 and described herein).

At an operation 1804, conductive pathways are provided for audio signals transferred to a second external source by a twisted pair of microphone wires associated with the set of microphones. The twisted pair of microphone wires is bound by a microphone cable. The twisted pair of microphone wires has a proximal end near the set of microphones and a distal end opposite the proximal end. At least a portion of the microphone cable is mechanically coupled to the earphone cable. In some embodiments, operation 1804 is performed by a second set of cables the same as or similar to first set of cables 110*d* (shown in FIG. 4 and described herein).

At an operation 1806, a first conductive pathway is provided between the proximal end of the first earphone wire and the first earphone, and provide a second conductive pathway between the proximal end of the second earphone wire and the second earphone by a first earphone connector. In some embodiments, operation 1806 is performed by the cable the same as or similar to cable(s) 110 (shown in FIG. 4 and described herein).

At an operation 1808, a third conductive pathway is provided between the distal end of the first earphone wire and the first external source, and a fourth conductive pathway between the distal end of the second earphone wire and the first external source by a second earphone connector. In some embodiments, operation 1808 is performed by a set of earphone connectors the same as or similar to earphone connectors 110*c* (shown in FIG. 4 and described herein).

At an operation 1810, a conductive pathway is provided between the proximal end of the twisted pair of microphone wires and the set of microphones by a first microphone connector. In some embodiments, operation 1810 is performed by a set of microphone connector the same as or similar to set of microphone connector 110*f* (shown in FIG. 4 and described herein).

At an operation 1812, a conductive pathway is provided between the distal end of the twisted pair of microphone wires and the second external source by a second microphone connector. In some embodiments, operation 1812 is performed by a set of microphone connectors the same as or similar to set of microphone connector 110*f* (shown in FIG. 4 and described herein).

Figure 19:
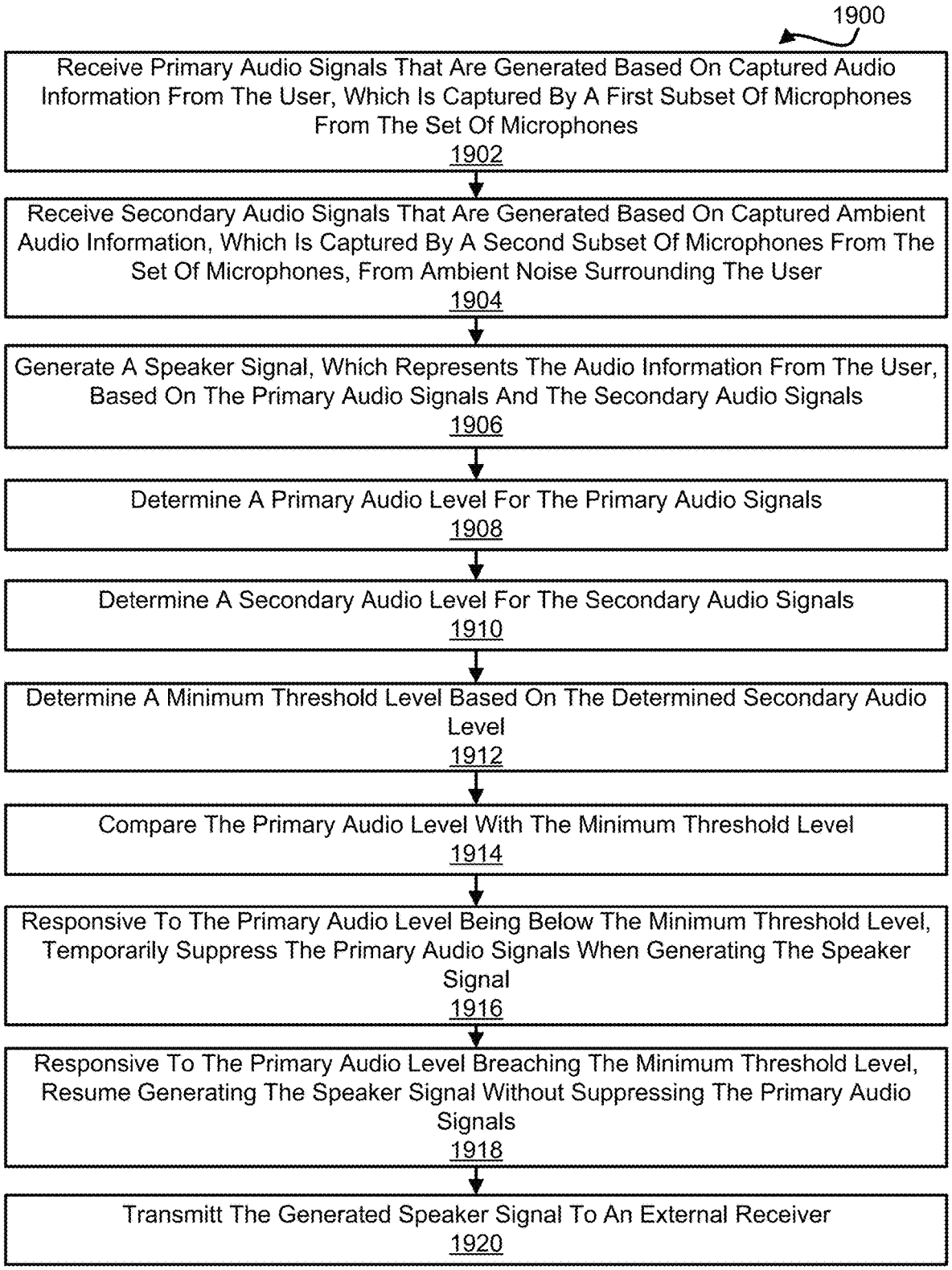
FIG. 19 illustrates the audio suppression method for the headset, in accordance with one or more embodiments.

FIG. 19 illustrates a method 1900 for determining when outgoing microphone output audio signals captured by sets of microphones may be transmitted. The operations of method 1900 presented below are intended to be illustrative. In some implementations, method 1900 may be accomplished with one or more additional operations not described, and/or without one or more of the operations discussed. Additionally, the order in which the operations of method 1900 are illustrated in 19 FIG. 19 and described below is not intended to be limiting.

In some implementations, method 1900 may include when the outgoing microphone output audio signals of the sets of microphones may be transmitted. In some implementations, method 1900 may determine when the outgoing microphone output audio signals of the sets of microphones may be transmitted based a comparison between the audio information. The audio information may include one or more of the captured speaker information, ambient information, and/or other information.

Figure 3:
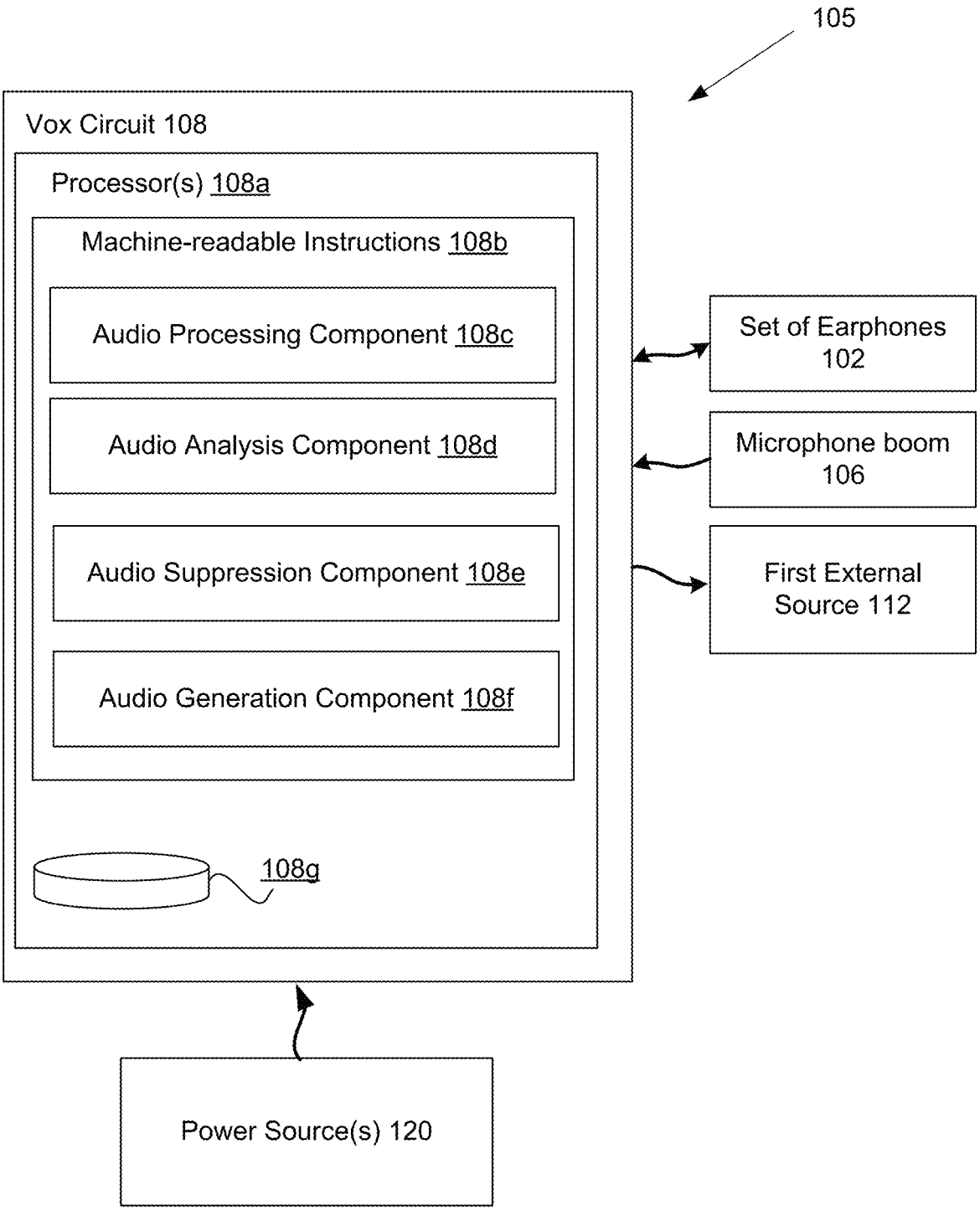
FIG. 3 illustrates the VOX circuit system of the headset, in accordance with one or more embodiments.

At an operation 1902, primary audio signals are received. The primary audio signals are generated based on captured audio information from the user. The audio information from the user is captured by a first subset of microphones from the set of microphones. In some embodiments, operation 1902 is performed by an audio processing component the same as or similar to audio processing component 108*c* (shown in FIG. 3 and described herein).

At an operation 1904, secondary audio signals are received. The secondary audio signals are generated based on captured ambient audio information from ambient noise surrounding the user. The ambient audio information is captured by a second subset of microphones from the set of microphones. In some embodiments, operation 1904 is performed by an audio processing component the same as or similar to audio processing component 108*c* (shown in FIG. 3 and described herein).

At an operation 1906, a speaker signal based on the primary audio signals and the secondary audio signals is generated. The speaker signal represents the audio information from the user. In some embodiments, operation 1906 is performed by an audio processing component the same as or similar to audio processing component 108*c* (shown in FIG. 3 and described herein).

At an operation 1908, a primary audio level for the primary audio signals is determined. In some embodiments, operation 1908 is performed by an audio processing component the same as or similar to audio processing component 108*c* (shown in FIG. 3 and described herein).

At an operation 1910, a secondary audio level for the secondary audio signals is determined. In some embodiments, operation 1910 is performed by an audio processing component the same as or similar to audio processing component 108*c* (shown in FIG. 3 and described herein).

At an operation 1912, the minimum threshold level based on the determined secondary audio level is determined. In some embodiments, operation 1912 is performed by an audio analysis component the same as or similar to audio analysis component 108*d* (shown in FIG. 3 and described herein).

At an operation 1914, the primary audio level with the minimum threshold level is compared. In some embodiments, operation 1914 is performed by an audio analysis component the same as or similar to audio analysis component 108*d* (shown in FIG. 3 and described herein).

At an operation 1916, responsive to the primary audio level being below the minimum threshold level, the primary audio signals are temporarily suppressed when generating the speaker signal. In some embodiments, operation 1916 is performed by an audio suppression component the same as or similar to audio suppression component 108*e* (shown in FIG. 3 and described herein).

At an operation 1918, responsive to the primary audio level breaching the minimum threshold level, the speaker signal resumes generation without the primary audio signals being suppressed. In some embodiments, operation 1918 is performed by an audio suppression component the same as or similar to audio suppression component 108*e* (shown in FIG. 3 and described herein).

At an operation 1920, the generated speaker signal to an external receiver is transmitted. In some embodiments, operation 1920 is performed by an audio generation component the same as or similar to audio generation component 108*f* (shown in FIG. 3 and described herein).

Although the system(s) and/or method(s) of this disclosure have been described in detail for the purpose of illustration based on what is currently considered to be the most practical and/or preferred implementations, it is to be understood that such detail is solely for that purpose and/or that the disclosure is not limited to the disclosed implementations, but, on the contrary, is intended to cover modifications and/or equivalent arrangements that are within the spirit and/or scope of the appended claims. For example, it is to be understood that the present disclosure contemplates that, to the extent possible, one or more features of any implementation can be combined with one or more features of any other implementation.

What is claimed is:

1. An audio suppression system for a headset with a set of microphones, wherein the audio suppression system is configured to temporarily suppress audio information from a user based on a comparison with a minimum threshold level, wherein the headset includes a headset microphone boom, wherein the headset microphone boom includes a boom tip arranged at or near a distal end of the headset microphone boom, wherein the audio suppression system comprises:

one or both of circuitry and one or more physical processors configured to:

receive primary audio signals, wherein the primary audio signals are generated based on captured audio information from the user, wherein the audio information from the user is captured by a first subset of microphones from the set of microphones, wherein the first subset of microphones includes at least four microphones arranged in a line along a first side of the boom tip, wherein the first side of the boom tip is facing the user when the headset is worn by the user;

receive secondary audio signals, wherein the secondary audio signals are generated based on captured ambient audio information from ambient noise surrounding the user, wherein the ambient audio information is captured by a second subset of microphones from the set of microphones;

generate a speaker signal based on the primary audio signals and the secondary audio signals, wherein the speaker signal represents the audio information from the user;

determine a primary audio level for the primary audio signals;

determine a secondary audio level for the secondary audio signals;

determine the minimum threshold level based on the determined secondary audio level;

compare the primary audio level with the minimum threshold level;

responsive to the primary audio level being below the minimum threshold level, temporarily suppress the primary audio signals when generating the speaker signal;

responsive to the primary audio level breaching the minimum threshold level, resume generating the speaker signal without suppressing the primary audio signals; and transmit the generated speaker signal to a first external source.

2. The system of claim 1, wherein the minimum threshold level is re-determined either periodically or continuously based on the received secondary audiosignals.

3. The system of claim 2, wherein magnitude of the primary audio level is measured in one or more of decibels, voltage, and current.

4. The system of claim 1, wherein the second subset of microphones includes at least two microphones.

5. The system of claim 1, wherein the first subset of microphones has a frequency response with a null at 7.5 kHz.

6. The system of claim 5, wherein one or both of the circuitry and the one or more physical processors are further configured to filter the frequency response of the speaker signal with a twin-tee filter having a notch at 7.5 kHz.

7. The system of claim 1, wherein individual ones of the first subset of microphones and individual ones of the second subset of microphones are Micro Electrical-Mechanical System (MEMS) microphones.

8. An audio suppression method for a headset with a set of microphones, wherein the audio suppression method is configured to temporarily suppress audio information from a user based on a comparison with a minimum threshold level, wherein the headset includes a headset microphone boom, wherein the headset microphone boom includes a boom tip arranged at or near a distal end of the headset microphone boom, wherein the audio suppression method comprises:

receiving primary audio signals, wherein the primary audio signals are generated based on captured audio information from the user, wherein the audio information from the user is captured by a first subset of microphones from the set of microphones, wherein the first subset of microphones includes at least four microphones arranged in a line along a first side of the boom tip, wherein the first side of the boom tip is facing the user when the headset is worn by the user;

receiving secondary audio signals, wherein the secondary audio signals are generated based on captured ambient audio information from ambient noise surrounding the user, wherein the ambient audio information is captured by a second subset of microphones from the set of microphones;

generating a speaker signal based on the primary audio signals and the secondary audio signals, wherein the speaker signal represents the audio information from the user;

determining a primary audio level for the primary audio signals;

determining a secondary audio level for the secondary audio signals;

determining the minimum threshold level based on the determined secondary audio level;

comparing the primary audio level with the minimum threshold level;

responsive to the primary audio level being below the minimum threshold level, temporarily suppressing the primary audio signals when generating the speaker signal; and responsive to the primary audio level breaching the minimum threshold level, resuming generating the speaker signal without suppressing the primary audio signals; and transmitting the generated speaker signal to an external receiver.

9. The method of claim 8, wherein the minimum threshold level is re-determined either periodically or continuously based on the received secondary audio signals.

10. The method of claim 9, wherein magnitude of the primary audio level is measured in one or more of decibels, voltage, and current.

11. The method of claim 8, wherein the second subset of microphones includes at least two microphones.

12. The method of claim 8, wherein the first subset of microphones has a frequency response with a null at 7.5 kHz, the method further comprising: filtering the frequency response of the of the speaker signal with a twin-tee filter having a notch at 7.5 kHz.

* * * * *